United States Patent [19]

Haynes

[11] 4,086,960

[45] May 2, 1978

[54] APPARATUS FOR HYDROCARBON RECOVERY FROM EARTH STRATA

[76] Inventor: Charles A. Haynes, 3308 Tipps Dr., Nederland, Tex. 77627

[21] Appl. No.: 661,325

[22] Filed: Feb. 25, 1976

Related U.S. Application Data

[62] Division of Ser. No. 538,591, Jan. 6, 1975, Pat. No. 3,986,556.

[51] Int. Cl.[2] ..... E21B 43/24

[52] U.S. Cl. ..... 166/59; 166/52; 166/260; 166/261; 166/266; 166/267; 166/75 R; 166/67

[58] Field of Search ..... 166/260, 261, 266, 53, 166/57, 64, 59, 75, 67, 272, 267, 52

[56] References Cited

U.S. PATENT DOCUMENTS

| | | | |
|---|---|---|---|
| 2,718,263 | 9/1955 | Heilman et al. | 166/261 X |
| 2,969,226 | 1/1961 | Huntington | 166/261 X |
| 3,019,838 | 2/1962 | Harlan et al. | 166/260 |
| 3,127,935 | 4/1964 | Poettmann et al. | 166/260 |
| 3,145,772 | 8/1964 | Huitt | 166/266 X |
| 3,150,716 | 9/1964 | Strelzoff et al. | 166/266 X |
| 3,194,311 | 7/1965 | Sheldon | 166/260 |
| 3,675,715 | 7/1972 | Speller, Jr. | 166/266 X |
| 3,881,550 | 5/1975 | Barry | 166/266 X |
| 3,913,673 | 10/1975 | Barber | 166/266 |
| 4,026,357 | 5/1977 | Redford | 166/261 |

*Primary Examiner*—Stephen J. Novosad

[57] ABSTRACT

A combination structure adapted for use in a catalytic process for stimulating the recovery of hydrocarbons from porous and permeable hydrocarbon bearing strata in earth formations utilizing at least one injection well and at least one production well both completed in said hydrocarbon bearing strata and a finely divided hydrocarbon cracking catalyst which is delivered by and through said structural combination of parts and elements to said strata by injection gas controlled at suitable pressure, temperature and $O_2$ content to promote and advance in place catalytic cracking of hydrocarbons and catalyst regeneration within said strata to be produced by utilizing said combination structure or its equivalent.

19 Claims, 7 Drawing Figures

APPARATUS FOR HYDROCARBON RECOVERY FROM EARTH STRATA

Figure 1:
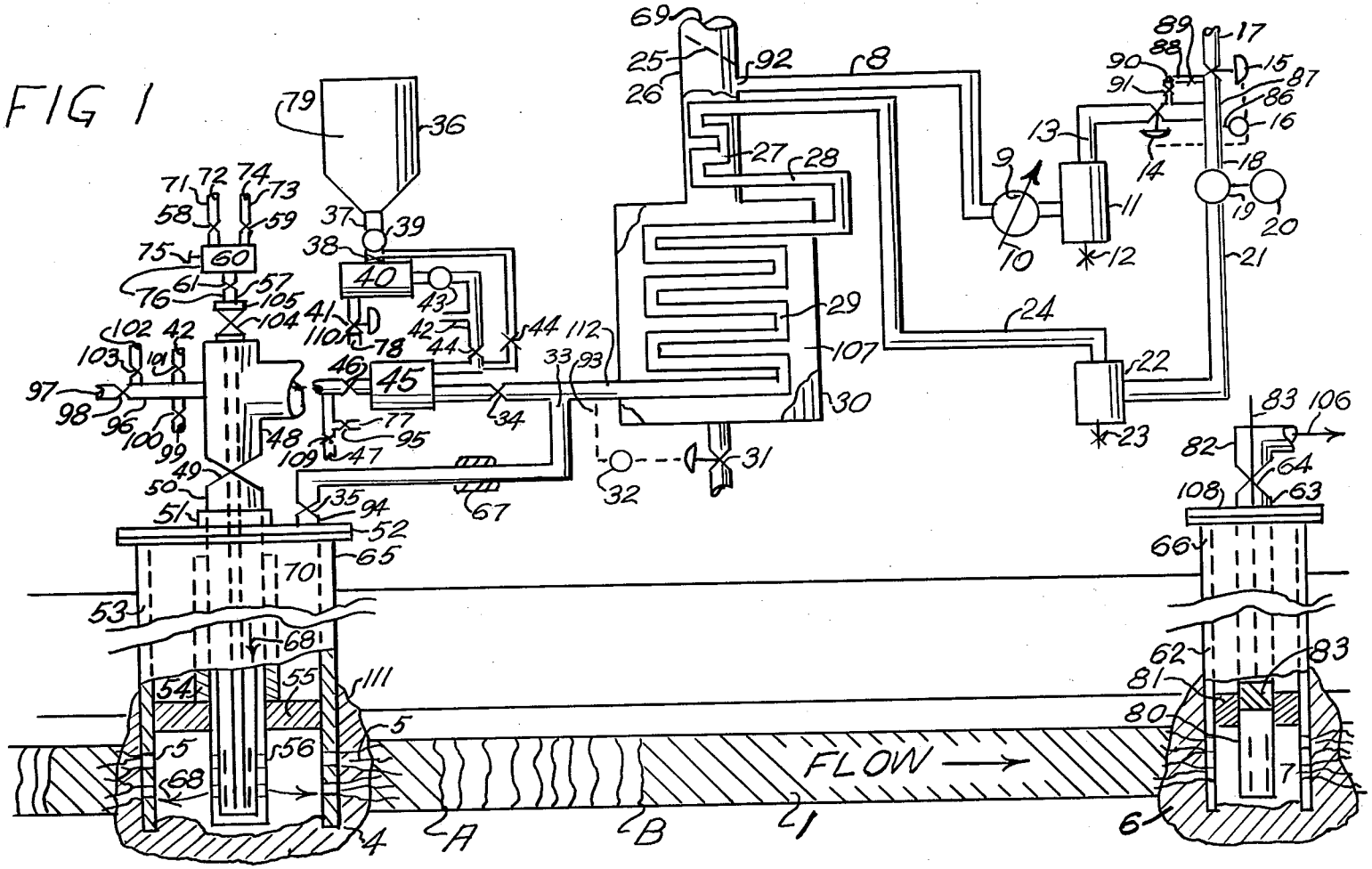

This is a divisional application for patent from the requirement of division of the Original U.S. Application for Patent entitled "HYDROCARBON RECOVERY FROM EARTH STRATA" made the subject of the combination structure and elements, and processes illustrated in the accompanying drawings being copies of the original (7) sheets of drawings filed with the original U.S. Application for patent bearing Ser. No. 538,591, filed 01/06/75, now U.S. Pat. No. 3,986,556.

The United States has produced approximately 33% of the known oil originally in place. In this time of declining crude oil production approximately 300 billion bbls. of known reserves await production providing methods that are technically and economically feasible can be developed. Why is oil recovery efficiency so low? Numerous works appearing in the literature attempt to answer this question and many solutions have been proposed over the years. A partial list of the reasons for low recovery efficiency are:

Dissipation of the lighter hydrocarbon components originally present in the reservoir fluid and produced with the crude in a solution drive production mechanism.

Depletion of gas pressure by not recycling produced gas during production. Surface tension of the oil which causes it to preferentially cling to the surface of the individual grains comprising the reservoir strata or the surface of the pores or crevices found in the rock strata. These surface areas amount to 5 - 25 $Mft^2/ft^3$ rock.

The higher viscosity of the oil with respect to driving media (gas or water) allows the driving media to slide by the oil leaving the largest part of the oil in place.

Accordingly the process of this invention attacks the above mentioned basic reasons for low recovery by catalytically cracking a portion of the heavier hydrocarbon molecules into lighter molecules. By producing small hydrocarbon molecules in place within the strata the process moves in the direction of reestablishing original reservoir conditions. In the case of hydrocarbon systems which are initially too viscous to be productive at the time of initial development, the catalytic process will also be effective. The process of this invention will convert heavy hydrocarbons into more mobile light molecules which are less viscous, act to dilute the uncracked heavy hydrocarbon molecules, provide additional gas sweep and heat transfer media until condensing in unreacted reservoir fluids, form solution phase drive fronts, and form a soluble oil drive flood phase. Surface generated heat and the heat liberated in the in place regeneration of the catalyst supply the endothermic heat required in the cracking process as well as that heat needed to establish the cracking temperature. Heat is also utilized in reducing the viscosity and surface tension of the unreacted hydrocarbons. The $CO_2$ produced in the catalyst regeneration (burning coke deposits off the surface of the catalyst) also aids in driving hydrocarbons to the producing well by forming a solution phase front when dissolved in the unreacted reservior fluid. By providing for in place catalyst regeneration the process advantageously causes the individual catalyst particles to be available as reaction sites repeatedly and tends to heat balance the reservoir system. Accordingly the objects of the process of this invention are:

Provide a catalytic cracking process to be conducted within a strata to increase ultimate hydrocarbon recovery from the porous and permeable hydrocarbon bearing strata.

Provide a process whereby the catalyst may be regenerated in place within the strata in order to perform the catalytic cracking repeatedly.

Provide a process in which the exothermic heat of catalyst regeneration is balanced against the endothermic heat requirements of catalytic hydrocarbon cracking directly within the strata; heat in excess of that required for the catalytic cracking is utilized directly in preheating hydrocarbons prior to cracking, heating uncracked hydrocarbons thereby making them more flowable by reducing their viscosity and surface tension, and vaporizing cracked hydrocarbons thereby improving their flowability or permeability.

Provide a process in which the catalyst regeneration products of CO, $CO_2$ and $H_2O$ stimulate hydrocarbon production by reducing hydrocarbon viscosity and surface tension, adding to the volume of the process' inherent gas drive and aiding heat transfer. In the case of $CO_2$ which when dissolved in hydrocarbons forms a solution phase which improves the gas drive efficiency.

Provide a process in which catalytically cracked hydrocarbon products are themselves more flowable and when the cracked hydrocarbons dissolve into uncracked hydrocarbons downstream within the strata reduce the viscosity and surface tension of the uncracked hydrocarbons making them more flowable.

Provide a process in which heated, pressurized injection gas used as a catalyst transport media or as a catalyst regeneration agent inherently provides a gas drive mechanism for pushing hydrocarbons thru the strata to the production well.

Provide a means of transporting catalyst to a hydrocarbon zone within a porous and permeable hydrocarbon bearing strata under suitable conditions of pressure and temperature to achieve catalytic cracking of hydrocarbons.

Provide a means of advancing the catalytic hydrocarbon cracking zone from the injection well to the production well by transporting regenerated catalyst from the regeneration zone to the hydrocarbon cracking zone.

Provide means of sizing hydrocarbon cracking catalyst particles so that said catalyst may be effectively delivered to and transported thru the hydrocarbon-bearing porous and permeable strata.

Provide a means of delivering to the porous and permeable hydrocarbon-bearing strata an initial catalyst charge in slurry form if conditions dictate.

Provide means of reducing the possibility of Na ion contamination of the aluminosilicate zeolite component of the catalyst by a preliminary treating step.

Provide a means of controlling the $O_2$ content of the injection gas if reservoir and hydrocarbon system response dictate the necessity of a varied $O_2$ content injection gas mode of operation.

Provide a catalytic process of cracking hydrocarbon deposited in hydrocarbon-bearing porous and permeable strata to stimulate the recovery of said hydrocarbons if the response of the reservoir/hydrocarbon system shows that a varied $O_2$ content operation would be more effective than a constant $O_2$ content operating mode.

Provide a means of controlling the injection temperatures of the catalyst and $O_2$ content of the injection gas as deemed suitable by the response of the particular reservoir/hydrocarbon system.

Provide a means of controlling the $O_2$ content of the of the injection gas to control the regenerating temperature and coke make depending upon the response of a particular reservoir/hydrocarbon system to the process of this invention.

Provide a stripping step in the operation of the process in order to maximize $O_2$ utilization and maximize hydrocarbon recovery.

Provide means of initiating the process of this invention.

Provide means of reverse flowing the strata produced in the process of this invention when the reservior/hydrocarbon system response to the process dictates.

FIG. 1 — A vertical elevation, partly in section, shows the overall arrangement and construction of various parts and elements used in the process of this invention "Hydrocarbon Recovery from Earth Strata".

Figure 2:
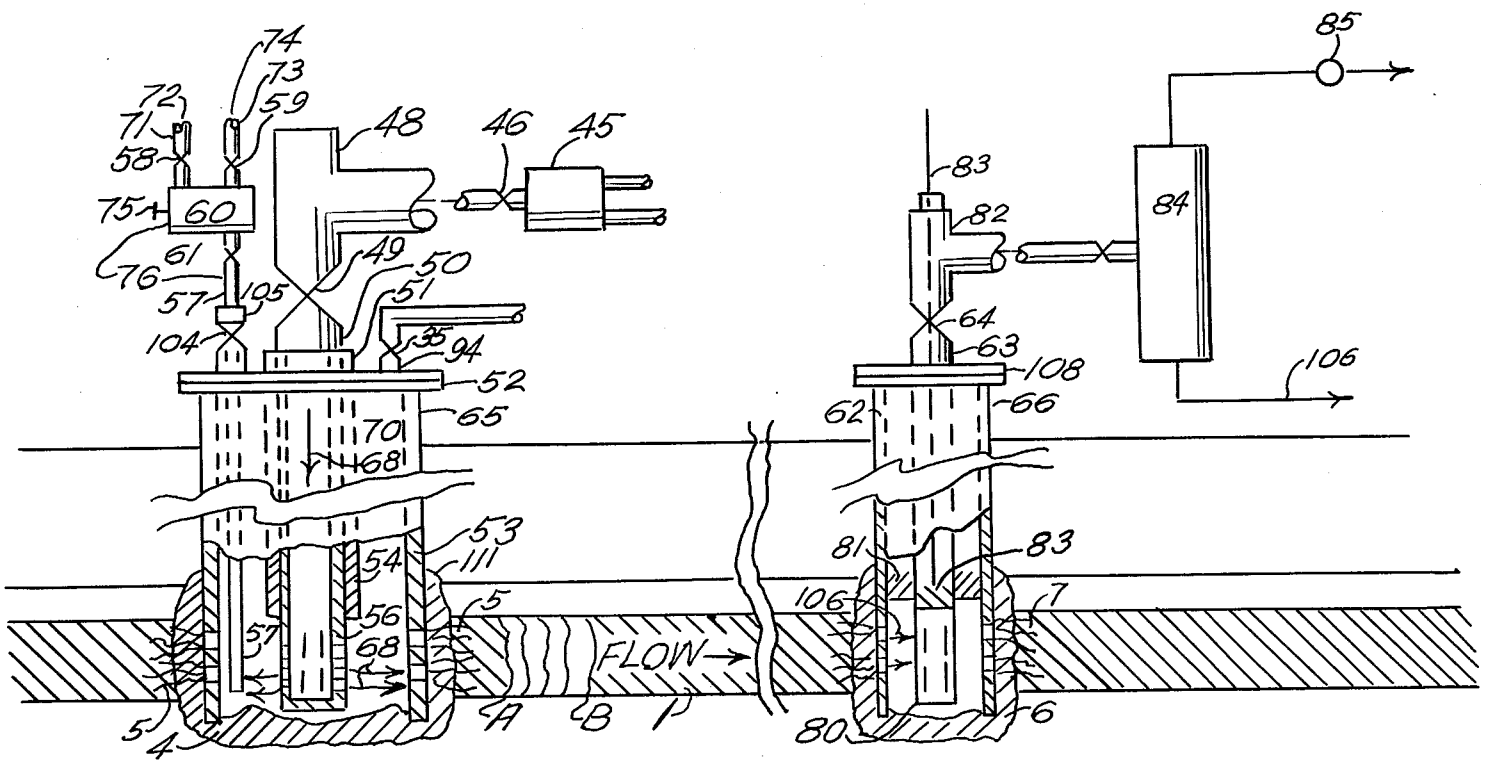

FIG. 2 — A fragmental vertical elevation, partly in section, shows an alternate location of the ignitor system and more complete production well equipment, and supplements FIG. 1 in showing overall arrangement and construction of various parts and elements used in the process of this invention "Hydrocarbon Recovery from Earth Strata".

Figure 3:
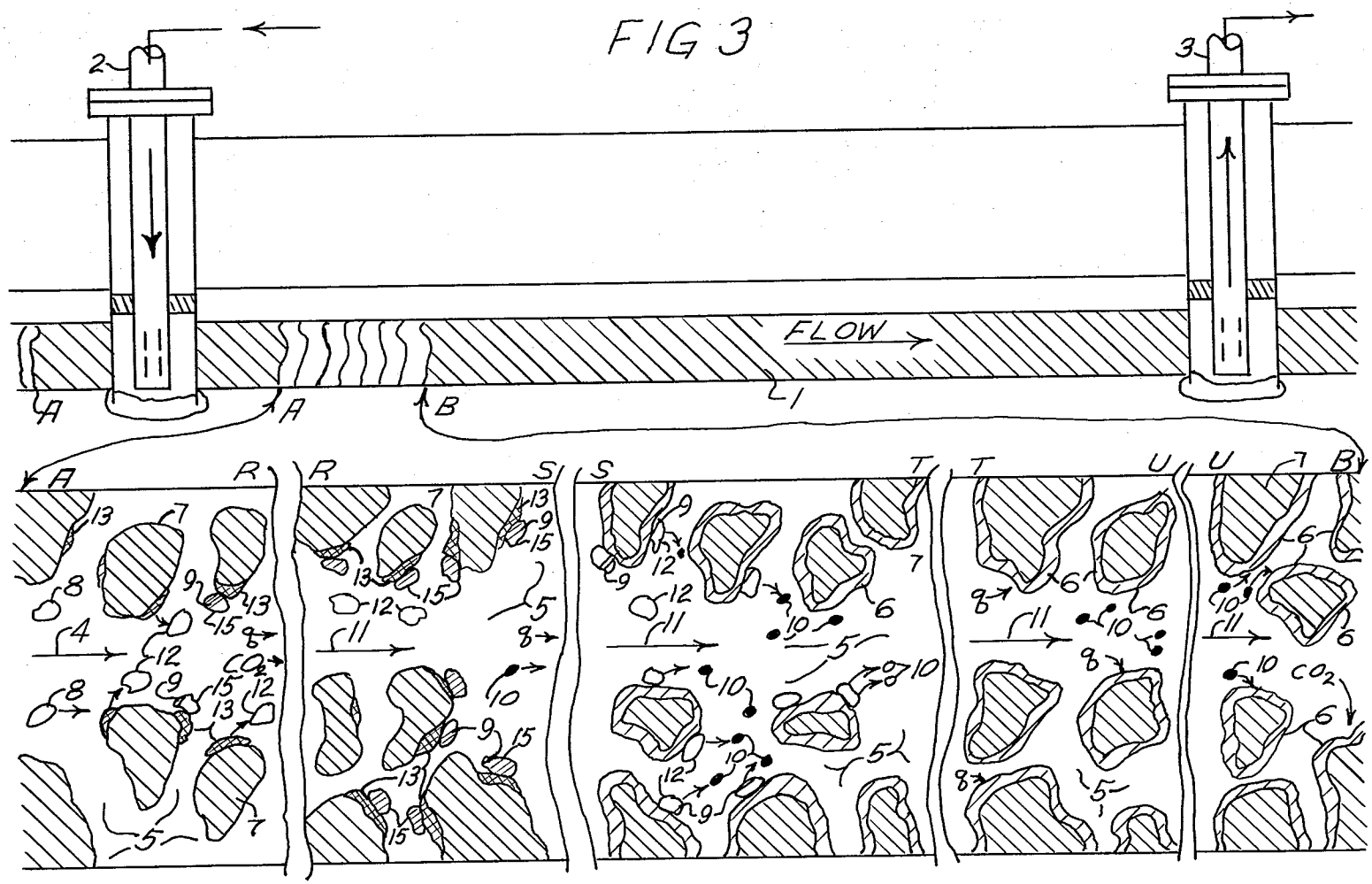

FIG. 3 — A process schematic of a partly sectional vertical elevation of the process of this invention "Hydrocarbon Recovery from Earth Strata", shows with blown up section AB, the active zone of the hydrocarbon strata, the chemical and physical processing operations occurring when active cracking catalyst is continuously delivered to the hydrocarbon strata by a heated $O_2$ containing injection gas.

Figure 4:
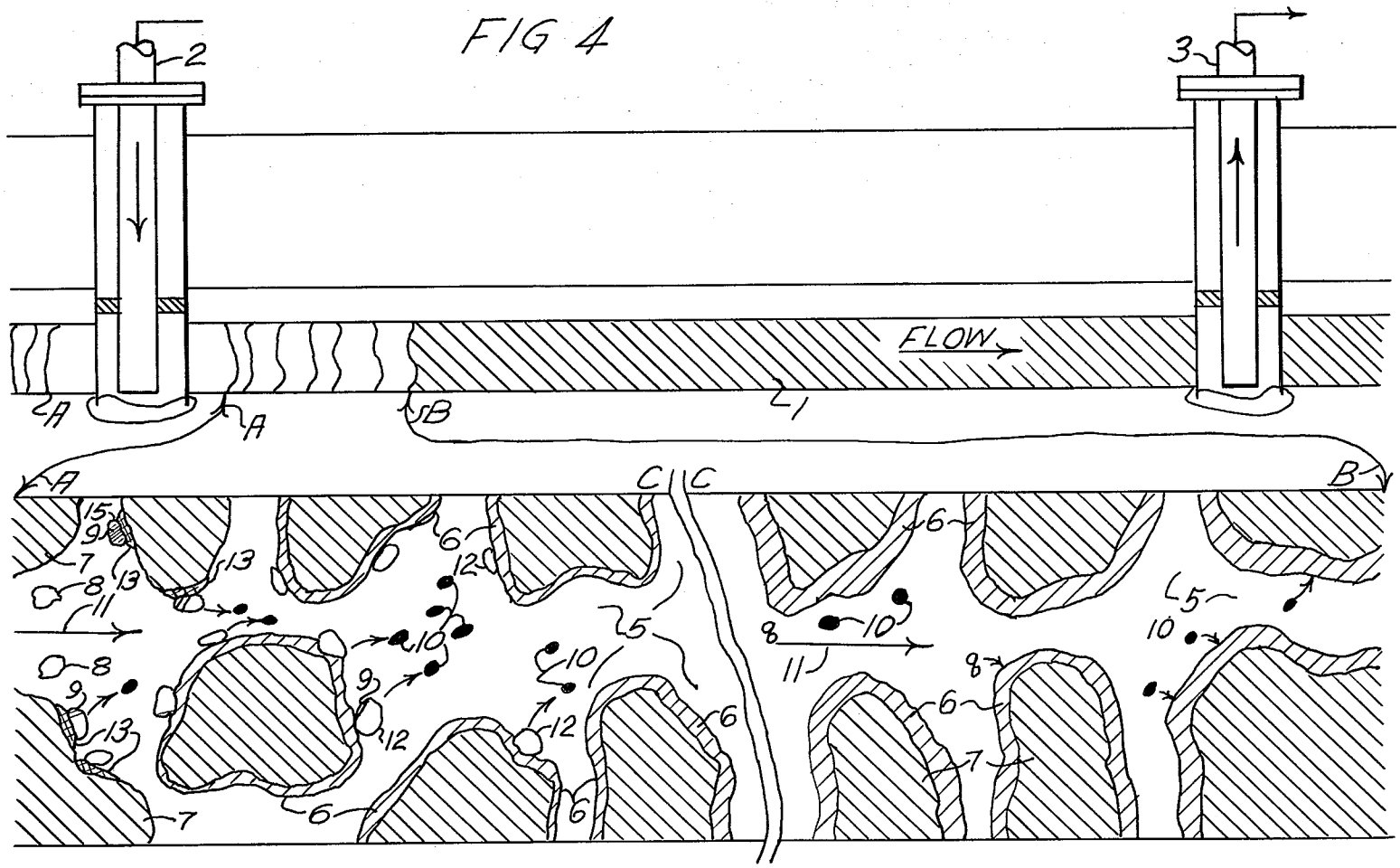

FIG. 4 — A process schematic of a partly sectional vertical elevation of the process of this invention "Hydrocarbon Recovery from Earth Strata", shows with blown up section AB, the active zone of the hydrocarbon strata, the chemical and physical processing operations occurring when active cracking catalyst is continuously delivered to the hydrocarbon strata by a heated inert injection gas for purposes of catalytically cracking hydrocarbons within said strata.

Figure 5:
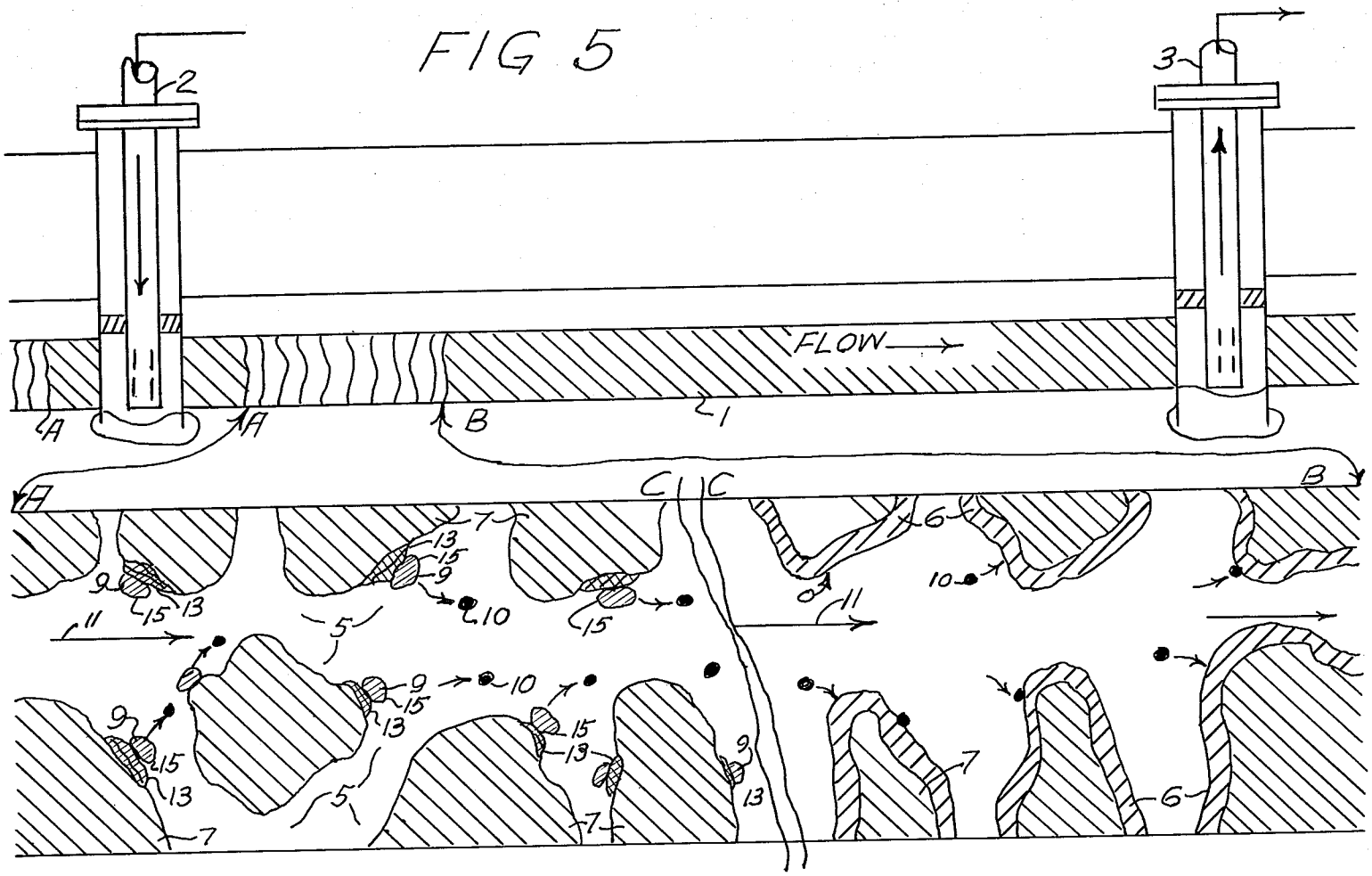

FIG. 5 — A process schematic of a partly sectional vertical elevation of the process of this invention "Hydrocarbon Recovery from Earth Strata" shows with blown up section AB, the active zone of the hydrocarbon strata, the chemical and physical processing operations occurring when heated inert injection gas is continuously delivered to said hydrocarbon strata for purposes of stripping volatile hydrocarbons off deactivated catalyst.

Figure 6:
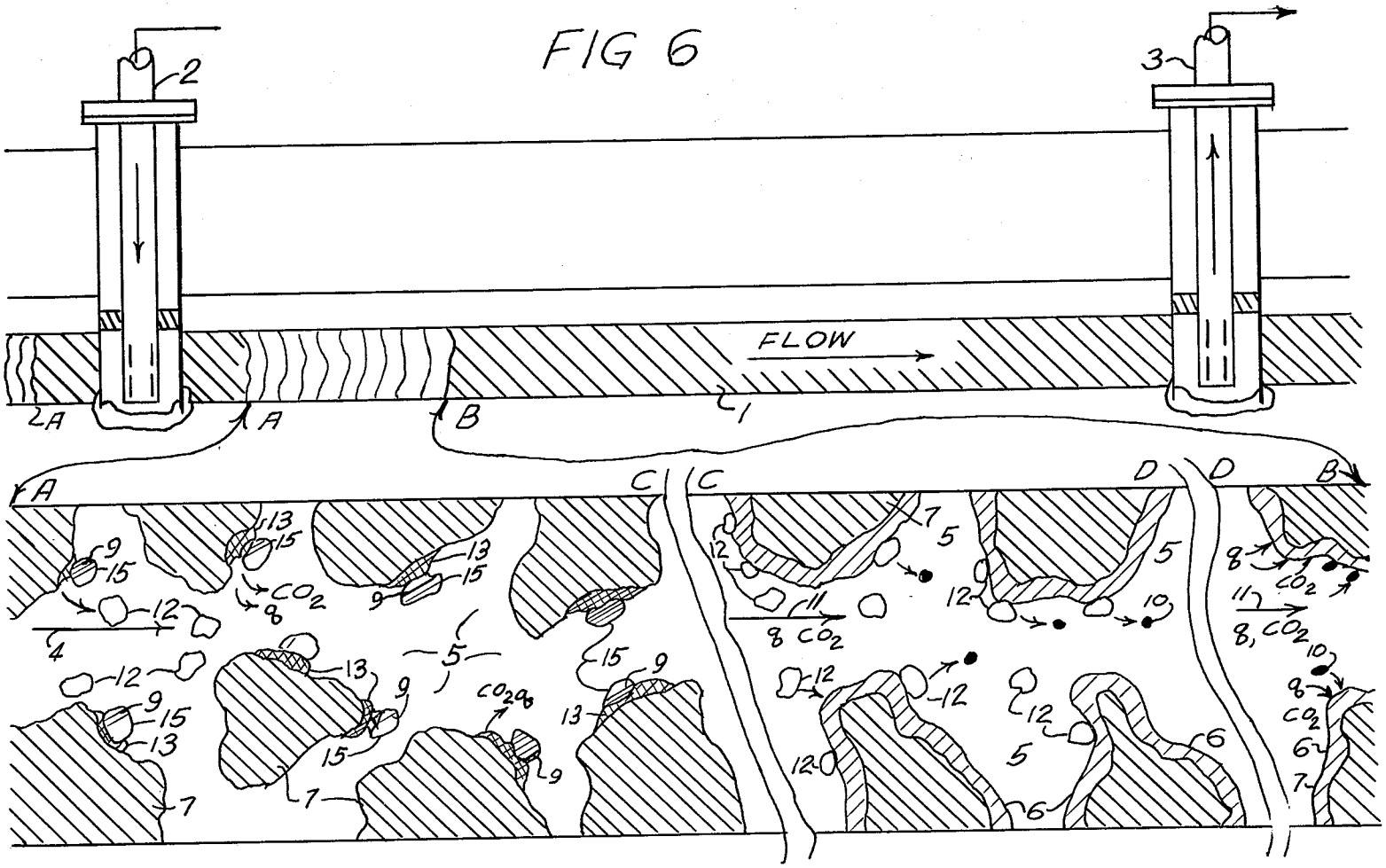

FIG. 6 — A process schematic of a partly sectional vertical elevation of the process of this invention "Hydrocarbon Recovery from Earth Strata" shows with blown up section AB, the active zone of the hydrocarbon strata, the chemical and physical processing operations occurring when heated $O_2$ containing injection gas is continuously delivered to said hydrocarbon strata for purposes of regenerating previously deactivated hydrocarbon cracking catalyst within said strata.

Figure 7:
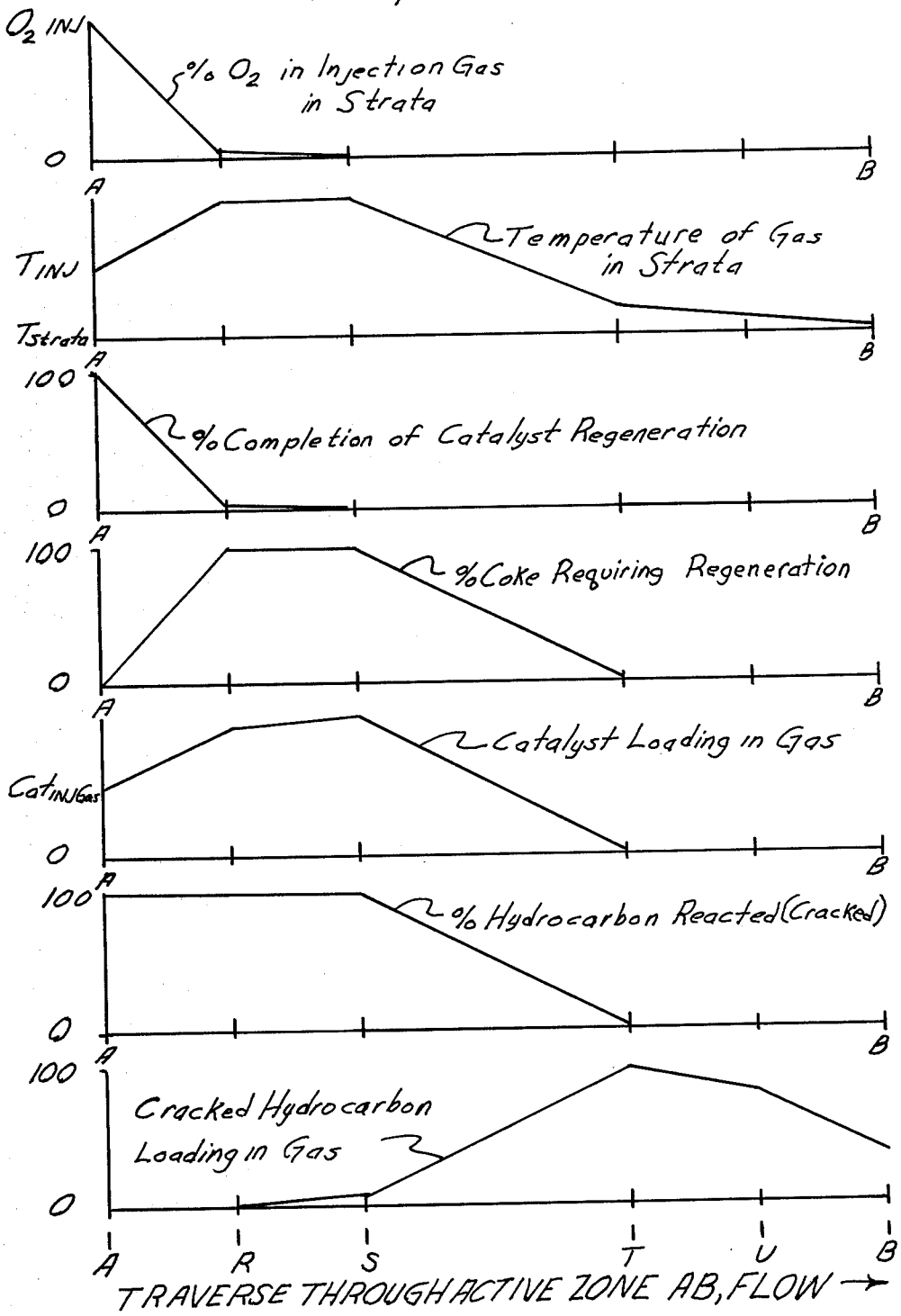

FIG. 7 — is a series of graphs showing operating variables plotted against traverse through active zone AB of the hydrocarbon bearing strata when active catalyst is continuously delivered by a heated $O_2$ containing injection gas. These graphs also illustrate the chemical and physical processing operations occurring within said strata active zone AB.

"The invention will be better understood from a more detailed description thereof, reference being had to the accompanying drawings wherein like numeraled and lettered parts and elements, therein denote like numeraled and lettered parts and elements herein."

Referring to FIG. 1, injection well 65 and production well 66 are shown completed in hydrocarbon bearing porous and permeable strata 1 which is to be produced by the catalytic hydrocarbon cracking process of this invention. Finely divided hydrocarbon cracking catalyst particles 79, of the variety commonly used in the petroleum refining industry, are stored in catalyst storage bin 36. Catalyst flows through the bin outlet line 37 to pressurized dry bulk feeder 39 which feeds the catalyst to either the mix drum 45 or to the catalyst slurrying mixer 40. Compressor 19 delivers hot injection gases 68 to the mix drum via furnace outlet header block valve 34 through the mix drum, mix drum outlet valve 46 to the injection well tubing manifold 48. The injection gases indicated by arrows 68 flow downwardly through injection tubing block valve 49, injection wall tubing 50, tubing slotted section 56, through casing 53 and casing bore hole cement 4 perforations 5 into hydrocarbon bearing strata 1. The injection well 65 having full depth casing 53 is hermetically sealed at the upper surface end by wellhead 52 which is fitted with tubing expansion gland 51. Said injection well tubing 50 extends downwardly through said expansion gland and bottoms such that the slotted tubing section 56 oppositely opposes said hydrocarbon strata 1. Said injection well tubing 50 is equipped with adjustable casing-tubing packer 55, adjacent the slotted tubing section that hermetically seals the tubing casing annulus 70. Insulation 54 covers the outer wall of said tubing 50 from the said packer 55 up to said wellhead in order to minimize heat loss. Insulation 67 also covers hot lines and equipment located on the surface as safe and economical operations dictate. Production well 66 shown completed in strata 1 consists of casing 62, casing-bore hole cement 6, tubing 63, extending through wellhead 108 and equipped with tubing-casing packer 81 adjacent the production tubing slotted section 80. Said production tubing slotted section 80 oppositely opposes the perforations 7 extending through the casing 62 and cement 6 and into said hydrocarbon strata. Said production well is equipped with a pumping unit 83, shown in FIG. 2, that extends downwardly through the tubing, bottoming adjacent the slotted section thereof. Referring to FIG. 2, the pumping unit discharges upwardly through said tubing 63, tubing block valve 64, production tubing manifold 82, and into the production separator 84. Production separator off gas vacuum pump 85 pulls suction on the gas outlet of the said production separator 84, thereby controlling the back pressure maintained on said strata 1. Referring to FIG. 1 injection compressor 19, driven by motor 20 delivers pressurized injection gas 68 to fired furnace 30 convection section coils 27 via compressor discharge header 21, compressor discharge knockout drum 22 and discharge knockout outlet transfer pipe 24. Furnace transfer pipe 28 delivers gas to the furnace radiant section coils 29. Furnace outlet temperature element 93 located in furnace outlet manifold 33, signals furnace outlet temperature controller 32 which adjusts furnace control valve 31, thereby maintaining suitable injection gas temperature. The furnace outlet manifold is connected to the injection well annulus 70 by wellhead connection 94 and annulus flow block valve 35. Said furnace outlet manifold 33 is also connected to the mix drum 45 via furnace outlet header block valve 34. A fuel gas supply pipe 47 and block valve 109 is in communication with said injection tubing manifold 48 downstream of the mix drum outlet valve 46. Also in communication with said injection tubing manifold 48 is the inert purge gas supply pipe 77 and valve 95. A strata pretreating manifold 96 is in communication with said injection tubing manifold 48. Located on said pretreating manifold 96 and in communication with the injection tubing manifold 48, are the following: a stream supply pipe 97 and stream block valve 98, a deionized water supply pipe 99 and deionized water block valve 100, a catalyst slurry supply pipe 42 and block valve 101, and an atmospheric vent 102 and block 103. Injection gas compressor 19 is equipped with suction header 18 in which is located gas analysis sensing element 86. Upstream of the compressor suction header 18 is compressor suction manifold 87, having the following in communication: an air intake control valve 15, an $O_2$ supply pipe 88 and $O_2$ block valve 89, an inert gas control valve 14 and a non-flue inert gas supply pipe 90, inert gas block valve 91. The air intake control valve 15 is in communication with an atmospheric air suction 17. The inert gas control valve is in communication with fired furnace 30 stack opening 92 via inert gas supply pipe 8, inert gas cooler 9, inert gas liquid knockout drum 11, and inert gas knockout outlet pipe 13. The cooling media 10 used in inert gas cooler 9 is either water or air which ever is available in the field. The knockout drums 11 and 22 are equipped with liquid drains 12 and 23 respectively. The ignitor system 76 used in the initiation of the process of this invention consists of an ignitor tubing 57 that extends downwardly through tubing manifold 48, injection well tubing 50 and bottoms oppositely opposed tubing slotted section 56. A retrieval block valve 104 and packing gland 105 are located at the top of said injection tubing manifold 48 which makes retrieval of the ignitor tubing 57 possible. At the upper end of said ignitor tubing 57 is a block valve 61 which allows ignitor tubing shut off. Above the block valve 61 is the ignitor chamber 60 in communication with fuel gas supply 71 and block valve 58 and air supply pipe 73 and block valve 59. The igniter chamber 60 is equipped with high voltage ignitor 75 by means of which the fuel gas 71 is ignited in said ignitor chamber 60 causing a flame to travel down said ignitor tube 57 to ignite fuel gas flowing from slotted tubing section 56 into strata 1 to bring about in place combustion of the hydrocarbons contained in strata 1. Catalyst 79 stored in said catalyst storage bin 36 is also delivered by said pressurized dry bulk feeder 39 to catalyst slurrying mixer 40. Slurrying fluid 78 controlled by flow control valve 41 flows into said slurrying mixer 40 which supplies a homogenous catalyst slurry to catalyst slurry pump 43 which discharges into slurry supply pipe 42. Said slurry supply pipe 42 is connected via block valve 101 to pretreating manifold 96 in communication with said injection well tubing 50 and is connected to said mix drum 45 via slurry pump block valve 44. Shown in fragmentary partly sectional elevation, FIG. 2 is an alternate ignitor system 76 which extends through the annulus 70 in injection well 65 which is completed without the adjustable packer. The numbering system used in FIG. 1 is also used in FIG. 2. Referring to FIG. 2 ignitor system 76 tubing 57 extends downwardly through injection well 65 annulus 70 bottoming oppositely opposed injection tubing slotted section 56.

Shown in FIG. 1 and FIG. 3 the process of this invention is in "steady state" operation. Active zone AB of hydrocarbon bearing porous and permeable earth strata 1 is experiencing catalytic hydrocarbon cracking and other related chemical processing operations, which are to be discussed below, brought about by continuously introducing under pressure via the injection well 65 a heated $O_2$ containing gas 68 and hydrocarbon cracking catalyst 79. Referring to FIG. 1, showing injection well 65 and production well 66 completed in porous and permeable hydrocarbon bearing strata 1, compressor 19 is delivering pressurized $O_2$ containing gas via compressor discharge knockout drum 22 to furnace convection section coils 27 and radiant section coils 29 in which heating of injection gas is accomplished. The temperature control of the heated, pressurized $O_2$ containing injection gas is sensed by furnace outlet temperature sensing element 93 located in furnace outlet manifold 33 which has insulation 67 as dictated by safe and efficient operations. Hot $O_2$ containing injection gas flows through furnace outlet header block valve 34 and into mix drum 45 where fresh hydrocarbon cracking catalyst 79 and said gas are mixed and flow through mix drum outlet block valve 46 to injection well tubing manifold 48. Flowing from the tubing manifold 48 the catalyst-carrying, hot, $O_2$ containing injection gases 68 flow downwardly through injection well tubing block valve 49, tubing 50 and tubing slotted section 56 oppositely opposed casing 53 and cement 4 perforations 5 into hydrocarbon bearing strata 1. The established direction of flow through the strata 1 is from injection well 65 to production well 66. The $O_2$ content of the $O_2$ containing gas is controlled by the gas analysis controller 16 that has a gas analysis sensing element 86 located in compressor 19 suction header 18. Control of the $O_2$ content is achieved by the controller 16 opening air intake control valve 15 on atmospheric air suction 17 and inert gas control valve 14 on inert gas supply pipe 8 as required. Both the air intake control 15 and the inert gas control 14 valves are connected to compressor suction manifold 87. Hydrocarbon cracking catalyst 79 stored in catalyst storage bin 36 is fed by a pressurized dry bulk feeder 39 to mix drum 45 where it is intimately mixed with the injection gas which then flows via said injection well tubing 50 into and through the hydrocarbon bearing strata 1 to said zone AB.

FIG. 3 is a schematic of the vertical elevation of the steady state operation of the process of this invention in which heated $O_2$ containing gas and catalyst are being continuously introduced into said strata 1 under pressure via injection well 65. Active zone AB of strata 1 is shown blown up to microscopically illustrate the chemical and physical phenomena taking place in the functional zones of catalyst regeneration AR, catalyst stripping RS, catalytic hydrocarbon cracking ST, hydrocarbon preheating TU, and solution UB. In FIG. 3, injection well 2 and production well 3 are shown completed in said hydrocarbon bearing strata 1. Flow is from well 2 to well 3 in the strata. Oxygen rich hot injection gas 4 is being delivered to strata 1 in place regeneration zone AR, the most upstream of the functional zones which has previously been subjected to the following processing operations: solution, preheating, catalytic cracking and stripping in that chronological order. Shown in FIG. 3 zone AR are sand grains 7, fresh catalyst 8 carried to strata 1 by $O_2$ rich injection gas 4, regenerated catalyst particles 12 freed to enter gas stream 4 flowing through strata pores 5, cracking residue 13 which binds deactivated catalyst 15 to sand or pore surfaces. Catalyst deactivation is caused by deposition of coke 9 on the catalyst surface. The catalyst regeneration zone is characterized by:

A. Deactivated catalyst particles 15 being burned clean of coke 9, released from the pore surfaces by the burning of cracking residue 13 binding them to the pore surfaces, and the regenerated catalyst particles 12 entering the hot regenerating gas 4 stream flowing downstream through said zone AR;

B. A hot fresh catalyst 8 carrying $O_2$ containing regenerating gas 4 which on entering said zone AR has maximum oxygen content and on exiting said zone AR is depleted of $O_2$ and is an inert gas 11;

C. A heat release brought about by the exothermic regeneration reaction;

D. A temperature rise in said zone AR caused by the release of regeneration heat;

E. Formation of regeneration products of CO, $CO_2$ and water vapor entering the inert gas stream 11 moving downstream through said strata 1 toward said production well 3.

Hot gases 11 exiting the catalyst regeneration zone AR, depleted of $O_2$ enter the stripping zone RS the second most upstream of the functional zones comprising active zone AB of strata 1 in FIG. 3. Said stripping zone RS has previously experienced the chemical processing operations of solution, preheating and catalytic cracking in the listed chronological order. The hot gas flow 11 containing regeneration products of CO, $CO_2$ and water vapor and transporting surface injected fresh catalyst 8 and regenerated catalyst 12 vaporize and drive volatile hydrocarbons from said stripping zone which is characterized by:

A. Deactivated catalyst particles 15 covered with coke deposits 9 and bound by cracking residue 13 to pore 5 surfaces (sand grain 7 surfaces);

B. A hot inert stripping gas 11, depleted of $O_2$ and containing regeneration reaction products maximizing the utilization of the compressor 19 (FIG. 1) capacity by removing $O_2$ consuming volatile hydrocarbons from the coke, catalyst and cracking residue and maximizing hydrocarbon recovery.

Hot gases 11 transporting fresh 8 and regenerated catalyst 12 exiting said stripping zone RS, enter the catalytic cracking zone ST, the third most upstream of the functional zones comprising active zone AB. The catalytic cracking zone has previously been subjected to the chemical processing operations of solution and preheating, chronologically, and is characterized by:

A. Regenerated 12 and fresh 8 catalyst, carried by $O_2$ deficient hot gases 11, being deposited on large uncracked hydrocarbon molecules 6 found clinging to and coating pore 5 surfaces of the strata 1 and contacting intermediate weight hydrocarbon molecules which may be vaporizing into the gas stream;

B. Large hydrocarbon molecules adsorbed on the catalyst surfaces being cracked into smaller more mobile molecules 10 which desorb the catalyst surface and vaporize into the gas stream flowing downstream through the hydrocarbon bearing strata toward the production well;

C. The deposition of coke 9 on the surface of the catalyst brings about catalyst deactivation;

D. The formation of cracking residue 13 which binds the catalyst particles to the pore surfaces once hydrocarbons present in the catalytic cracking zone have been effectively "cracked out"

E. Concentration gradients of cracking residue 13 which are at the highest concentration levels at the inlet of the cracking zone and are at progressively lower concentration levels at each succeeding point downstream within said catalytic cracking zone ST;

F. Concentration gradients of uncracked hydrocarbons 6 having the lowest concentration at the inlet of the catalytic cracking zone and the highest concentration at the outlet of the catalytic cracking zone;

G. The delivery of heat to the catalytic cracking zone by the hot gases 11 flowing from said regeneration AR and stripping RS zones thereby maintaining the required cracking temperature and supplying the necessary endothermic heat of catalytic cracking. These concentration gradients are graphically presented in FIG. 7. Hot inert gases 11 leaving the catalytic cracking zone containing vaporized hydrocarbon cracking products 10 and regeneration products CO, $CO_2$ and water vapor enter the preheating zone TU containing uncracked hydrocarbons 6. Said preheating zone, the fourth most upstream of the functional zones, comprising hydrocarbon bearing strata 1 active zone AB having been previously subjected to the chemical process operation of solution. Preheating zone TU is characterized by:

A. Uncracked hydrocarbons 6 clinging to the surface of the pores 5 and crevices found in the porous and permeable hydrocarbon bearing earth strata 1;

B. A flow of hot gas 11 containing catalyst regeneration products of CO, $CO_2$ and water vapor, a range of hydrocarbon catalytic cracking products 10, and nitrogen contained in the injection gas introduced at the surface;

C. Heat q transferred to the uncracked hydrocarbons 6 from the hot gases flowing through the preheating zone thereby raising the temperature of said uncracked hydrocarbons 6 to that required for the catalytic cracking reaction;

D. Improving the mobility of the uncracked hydrocarbon 6 by raising their temperature thereby lowering the surface tension and viscosity of said uncracked hydrocarbons. Cooled inert gases 11 leaving the preheating zone TU and entering the solution zone UB the most downstream of the functional zones of the active zone AB of strata 1. Functional zone UB, the solution zone is being subjected to the initial processing operation of the process of this invention. Said solution zone is characterized by A. Uncracked hydrocarbons 6 clinging to the surfaces of pores 5 and crevices found in the porous and permeable hydrocarbon bearing earth strata 1;

B. Flowing inert gas 11 originally containing catalyst regeneration products of CO, $CO_2$ and water vapor, a range of hydrocarbon catalytic cracking products 10, and nitrogen introduced into strata 1 via the injection gas originating at the surface, a portion of cracked hydrocarbons 10 having been cooled in said preheat zone TU to their dew point are condensing in said zone UB;

C. The condensing cracked hydrocarbon 10 components are going into solution in the uncracked hydrocarbons 6 found in said zone UB of the strata 1;

D. The $CO_2$ is dissolved into the uncracked hydrocarbons found in said zone UB of the strata 1 forming a solution phase which is more effectively driven through said strata 1 toward the production well 3 by the gas drive mechanism inherent in the injection gas utilized in the process of this invention;

E. The forming of solution phases of cracked hydrocarbons 10 and $CO_2$ absorbed into the uncracked hydrocarbons 6 improves the mobility of uncracked hydrocarbons 6 by reducing surface tension and viscosity of said uncracked hydrocarbons 6. Continued operation of the process of this invention by introducing heated $O_2$ containing gas and said hydrocarbon cracking catalyst advances said active zone AB through said strata 1 from injection well 2 to production well 3 thereby bringing about increased recovery of said hydrocarbons from said strata 1.

Due to the varied geological and physical properties of the hydrocarbon bearing porous and permeable earth strata and to the numerous variations in the chemical and physical properties of the hydrocarbons, the reponse of one particular reservoir/hydrocarbon system to the process of this invention that of catalytically stimulating hydrocarbon recovery from earth strata will differ from the response of another system. For this reason the mode of operation, independent process variables or techniques may be varied accordingly.

A second mode of operation of the process of this invention, is discussed in detail below. Reference will be made to FIG. 1, the overall process vertical elevation that is partly sectional. Also referred to in the discussion of this mode will be FIGS. 4, 5, 6, which are schematic vertical elevations also partly sectional with enlarged views of the hydrocarbon strata illustrating microscopic details of rock grains, rock pores, catalyst and hydrocarbons. FIGS. 4, 5, and 6 illustrate the steps of catalytic hydrocarbon cracking, catalyst stripping and catalyst regeneration, respectively. In the second mode of operation of catalytically producing hydrocarbons from earth strata in the process of this invention shown in FIG. 1 and in FIGS. 4, 5 and 6, active zone AB of strata 1 is an established operating zone undergoing chemical processing steps of catalytic cracking of hydrocarbons, stripping of volatile hydrocarbons from deactivated catalyst and catalyst regeneration performed in a repetitive manner. Referring to FIG. 1, showing injection well 65 and production well 66 completed in porous and permeable hydrocarbon bearing strata 1, compressor 19 is delivering pressurized inert gas obtained by the action of gas analysis controller 16 which automatically opens inert gas control valve 14 and closes air intake control valve 15. The pressurized inert gas flows via compressor discharge knockout drum 22 to furnace convection section coil 27 and radiant section coils 29 in which heating of injection gas 68 is accomplished. The temperature of said heated, pressurized inert injection gas sensed by furnace outlet temperature sensing element 93 located in furnace outlet manifold 33 and is controlled by furnace outlet temperature controller 32 which operates furnace control valve 31. Insulation 67 covers all hot gas transfer lines and equipment as dictated by safe and efficient operations. Said hot inert injection gas flows via furnace outlet header block valve 34 into mix drum 45 where fresh hydrocarbon cracking catalyst 79 and injection gas are mixed and flow through mix drum outlet block valve 46 to injection well tubing manifold 48. Flowing from the tubing manifold 48, the catalyst-carrying, hot, inert injection gases 68 flow downwardly through injection well tubing block valve 49, tubing 50 having insulation 54, tubing slotted section 56 and casing 53 and cement 4 perforations 5 into said oppositely opposed hydrocarbon bearing strata 1. The established direction of flow through said strata 1 is from said injection well 65 to said production well 66.

Hydrocarbon cracking catalyst 79 stored in catalyst storage bin 36 is fed by pressurized dry bulk feeder 39 to mix drum 45 where it is intimately mixed with said hot injection gas 68 which admixture then flows via said injection well tubing 50 into and through said hydrocarbon bearing strata 1 to said zone AB.

FIG. 4 is a schematic of the vertical elevation of the mode of operation in which catalytic cracking of hydrocarbons is established in said active zone AB of said earth strata 1. Active zone AB is shown blownup to microscopically illustrate the chemical and physical phenomena taking place within the strata during the catalytic cracking step of the process. Referring to FIG. 4, injection well 2 and production well 3 are shown completed in hydrocarbon bearing strata 1 with inert injection gas 11 flow direction established from injection well to production well. Said hot injection gas 11 is shown transporting and delivering fresh catalyst 8 to hydrocarbon catalytic cracking zone AC. Shown in FIG. 4 of said zone AC are sand grains 7, uncracked hydrocarbons 6 coating sand grains and clinging to surfaces of the strata pores 5, coke 9 being deposited on catalyst surfaces, deactivated catalyst 15 bound to pore surfaces by cracking residue 13, cracked hydrocarbon products 10 desorbing the catalyst surfaces and entering the gas stream flowing downstream through said strata 1 to the production well. Said cracking zone AC of the hydrocarbon catalytic cracking cycle step of the process is characterized by hot active catalyst 8, contacting and adsorbing previously heated large molecular weight hydrocarbons 6 found either clinging to the pore 5 surfaces within the strata or vaporizing into the gas stream, cracks said large molecules 6 into smaller more mobile hydrocarbon molecules 10, which desorb the catalyst and enter the flowing inert gas stream 11, and cracking reaction coproducts of coke deposits 9 on catalyst and cracking residue 13 which binds the spent catalyst to said strata pore surface within said catalytic hydrocarbon cracking zone AC; thereby producing a supply of smaller hydrocarbon molecules 10 which flow downstream thru the hydrocarbon bearing strata toward the production well.

Solution zone CB of FIG. 4 showing inert gas 11, uncracked hydrocarbons 6, cracked hydrocarbon products 10, and heat $q$. Said solution zone CB located within strata 1 downstream of catalytic cracking zone AC is characterized by a flow of hot inert gas 11 and cracked hydrocarbons 10 which deliver heat $q$ to said uncracked hydrocarbons 6 and raises the temperature of said uncracked hydrocarbons 6 reducing their viscosity and surface tension making said hydrocarbons 6 more flowable, simultaneously said light hydrocarbon cracking products 10 being cooled to their dew point in their traverse through said strata 1 condense and dissolve into said uncracked heavy hydrocarbons 6 also bringing about a reduction in viscosity and surface tension thereby making them more susceptible to being driven toward the production well by the inert gas sweep mechanism inherent in the process.

FIG. 5 is a schematic of the vertical elevation partly sectional of stripping step utilized in the second mode of operation of catalytically producing hydrocarbons from earth strata in the process of this invention with active processing zone AB established. Active zone AB is shown blownup to microscopically illustrate the chemical and physical phenomena taking place within the strata during the catalyst stripping step of the process. Injection well 2 and production well 3 are shown completed in hydrocarbon bearing strata 1 with inert injection gas 11 flow established within said strata 1 from said injection well 2 to said production well 3. Hot injection gas is shown flowing into catalyst stripping zone AC. Shown in said zone AC are sand grains 7, strata pores 5, deactivated catalyst 15, coke 9, cracking residue 13, and cracked hydrocarbons 10. Said stripping zone AC of the catalyst stripping cycle step of the process is characterized by shutting down surface addition of said heated catalyst 79 to said hydrocarbon bearing porous and permeable strata 1 but continuing the flow of hot inert injection gas 11 to bring about the stripping of volatile hydrocarbons 10 from said coke 9, deactivated catalyst 15 and cracking residue 13 found in the previous catalytic hydrocarbon cracking zone thereby removing valuable hydrocarbons contained therein prior to initiating the subsequent regeneration step which burns any combustible materials present in this zone AC.

FIG. 6 is a schematic of the partly sectional vertical elevation of the catalyst regeneration step of this mode of operation of catalytically producing hydrocarbons from earth strata in the process of this invention with active processing zone AB established. Said active zone AB is shown blownup to microscopically illustrate the chemical and physical phenomena taking place within said strata 1 during the catalyst regeneration step of the process. Injection well 2 and production well 3 are shown completed in the hydrocarbon bearing strata 1 with $O_2$ containing injection gas 4 flow direction established within said strata 1 from said injection well 2 to said production well 3. Shown in said catalyst regeneration zone AC are sand grains 7, cracking residue 13, deactivated catalyst 15, coke 9, regenerated catalyst 12, heat *q*, combustion products CO, $CO_2$ and inert gas 11. Said catalyst regeneration zone AC of the catalyst regenerating step of the process is characterized by the delivery of hot $O_2$ containing injection gas 4 to said strata zone AC via said injection well 2, accomplished by raising the $O_2$ demand on the gas analysis controller 16 of FIG. 1 which opens air intake control valve 15 and closes inert gas control valve 14. Referring to FIG. 6 the hot $O_2$ containing injection gas 4 brings about the regeneration and liberation of deactivated catalyst found in previously cracked and stripped zone AC by burning said coke deposits 9 off catalyst 15 and the burning of said cracking residue 13 binding said catalyst 15 to the pore 5 surfaces. This combustion produces heat *q*, CO, $CO_2$ and water vapor and frees regenerated catalyst 12, which enter the $O_2$ depleted inert gas stream 11 exiting said regeneration zone AC. Heat *q* produced in the exothermic regeneration reaction is balanced against and provides the endothermic catalytic cracking heat requirements. Zone CD of FIG. 6 located downstream of said regeneration zone AC within said strata 1 is shown receiving said inert gas 11 transporting heat *q*, regenerated catalyst 12 which brings about the catalytic cracking of uncracked hydrocarbons 6 thereby advancing the catalytic cracking process through said strata 1. Zone DB of FIG. 6 located downstream of both said regeneration zone AC and said newly established catalytic cracking zone CD is shown receiving inert gas 11 transporting heat *q*, cracked hydrocarbons 10 and $CO_2$ all which are absorbed by the uncracked hydrocarbons 6, found clinging to the pore 5 surfaces within zone DB of strata 1. This absorption of heat, light hydrocarbons, and $CO_2$ improves the mobility of the uncracked hydrocarbons 6 by reducing their viscosity and surface tension. The $CO_2$ forms a solution phase with the hydrocarbons which improves the effectiveness of the gas drive mechanism inherent in said injection gas used in the process of the invention thereby causing a portion of said hydrocarbons 6 to be driven through said strata 1 toward said production well 3.

Repeating of said steps of catalytic cracking, catalyst stripping and catalyst regeneration advances said active zone AB through said strata 1 from said injection well 2 to said production well 3 thereby producing hydrocarbons from said earth strata 1.

Referring to FIG. 1 the initiation or start up of the process of this invention basically consists of preheating the strata in the vicinity of injection well 65 to a temperature range of 600° – 1050° F suitable for promoting and sustaining catalytic cracking of hydrocarbons found within said strata 1 to be produced. Initiation may be accomplished by delivering hot injection gases 68 to said strata 1 prior to and during the introduction of hydrocarbon cracking catalyst. Initiation may also be accomplished by first establishing in place combustion of the hydrocarbons in the vicinity of injection well 65 within said strata 1 by any of the methods commonly used followed by catalyst 79 injection into strata 1 via injection well 65. Examples of the numerous start up techniques available to the operator of the process of this invention will be detailed below and are summarized as:

A. Inert gas preheating, lining up $O_2$ containing gas and fuel gas to the injection well and using an ignitor system positioned in the injection well tubing to fire the hydrocarbon strata;

B. Inert gas heating to the temperature level required for catalytic cracking followed by regeneration with $O_2$ containing gas;

C. Inert gas heating of hydrocarbons followed by spontaneous combustion of hydrocarbons upon introducing $O_2$ containing gas followed by injection of catalyst;

D. Introducing hot $O_2$ containing gas for the purpose of bringing about hydrocarbon combustion followed by injecting catalyst into strata;

E. Introducing $O_2$ containing gas and fuel gas through the injection well, firing fuel gas by the ignitor to bring about combustion of hydrocarbons followed by injection of cracking catalyst;

F. Preheating with inert gas followed by introducing hot $O_2$ containing gas via the injection well annulus, fuel gas via the injection well tubing igniting fuel gas with an annulus-placed ignitor to bring about firing of fuel gas from tubing thereby causing combustion of hydrocarbons in strata followed by catalyst addition; and, G. Introducing hot $O_2$ containing gas via the injection well annulus, fuel gas via the injection well tubing igniting fuel gas with an annulus placed ignitor to bring about firing of fuel gas from tubing thereby causing combustion of hydrocarbons in strata followed by catalyst addition.

Initiation of the process of this invention follows the strata pretreating, when required, and is hereinafter later discussed immediately following the description of the hydrocarbon cracking catalyst used in the process of this invention. Each of the previously summarized initiation techniques are described below:

A. Initiation by inert gas preheating, lining up $O_2$ containing gas and fuel gas to the injection well and using an ignitor system positioned in the injection well tubing to fire the hydrocarbon bearing strata. Referring to FIG. 1 gas analysis controller 16 set for inert gas operation opens inert gas control valve 14 and closes air intake control valve 15. Compressor 19 delivers pressurized inert gas to furnace 30 which heats the inert gas to the temperature required for injection into and preheating hydrocarbon bearing strata 1 flowing via injection well manifold 48, injection well tubing 50 and injection tubing slotted section 56. Introducing under pressure heated inert gases 68 through the perforated holes 5 in the casing 53 and cement 4 into said opposed hydrocarbon bearing strata 1 to preheat the immediate area of said hydrocarbon bearing strata 1 and the contained hydrocarbons to a temperature level sufficient to bring about a rapid ignition of in place hydrocarbons when $O_2$ containing gas is introduced into the strata 1 via the injection well 65; setting gas analysis controller 16 for $O_2$ containing gas operation thereby opening air intake valve 15, lining up fuel gas 47 to the injection well tubing 50, lining up $O_2$ containing injection gas 68 through the injection well annulus 70 via opened annulus flow block valve 35 and the adjustable casing packer 55, and activating the fuel gas/air ignitor system 76 by opening fuel gas valve 58 and air valve 59 and activating high voltage ignitor 75 thereby igniting the fuel gas 47 flowing from the slotted tubing section 56 effectively producing a fuel gas fired burner which under conditions of excess air available from the casing annulus 70 brings about burning of the hydrocarbons in said strata 1 in the immediate region of the injection well 65, shutting down fuel gas 47 flow through the injection well tubing 50, purging the tubing with an inert gas 77 for safety reasons, and opening valve 46 to establish flow of hot $O_2$ containing gas through said tubing 50 to support the in place burning of hydrocarbons located within said strata 1 in the immediate region of the injection well 65, closing said adjustable casing packer 55 to shut down flow through the annulus 70; and starting catalyst 79 injection carried by said $O_2$ containing injection gases 68 flowing through said injection tubing 50, through said slotted tubing section 56 and said casing and cement perforations 5 through the in-place hydrocarbon burning front within the strata 1 thereby delivering hot catalyst 79 with $O_2$ depleted combustion-product gases to heated hydrocarbons and establishing a catalytic hydrocarbon cracking zone; maintaining catalyst injection, carried by heated $O_2$ containing injection gas 68 through said tubing 50 and perforations 5 into said hydrocarbon bearing porous and permeable strata 1 thereby establishing a catalyst regeneration zone, a catalyst stripping zone a catalytic hydrocarbon cracking zone, a hydrocarbon preheating zone and a solution zone which are located in series within the hydrocarbon bearing strata 1 along the direction of flow from the injection well 65 to the production well 66.

B. Initiation by inert gas heating to temperature level required for catalytic cracking followed by catalyst regeneration using an $O_2$ containing gas. Referring to FIG. 1 gas analysis controller 16 set for inert gas operation opens inert gas control valve 14 and closes air intake control valve 15. Compressor 19 delivers pressurized inert gas to furnace 30 which heats the inert gas to the temperature required for injection and heating hydrocarbon bearing strata 1 flowing via injection well manifold 48, injection well tubing 50 and injection tubing slotted section 56. Introducing under pressure heated inert injection gases 68 through the perforated holes 5 in casing 53 and cement 4 into said opposed hydrocarbon bearing strata 1 to preheat the immediate area of said strata 1 and the contained hydrocarbons to a temperature level sufficient to support catalytic cracking of hydrocarbons; introducing finely divided catalyst 79 particles into said heated, pressurized and inert injection gas 68 stream such that the hot catalyst 79 is contacted with the heated hydrocarbons in place within said hydrocarbon bearing porous and permeable strata 1 thereby bringing about the catalytic cracking of large molecular weight hydrocarbons into smaller more flowable hydrocarbon reaction products and the catalytic cracking reaction co-products of coke on catalyst and cracking residue; and increase $O_2$ set point on gas analysis controller 16 which closes inert gas control valve 14 and opens air intake control valve 15 thereby raising the $O_2$ content of said heated, pressurized, catalyst-carrying injection gas 68 stream to a level suitable for burning the coke off the previously injected and deactivated catalyst which is bound by cracking residue to hydrocarbon-depleted pore surfaces within said strata 1 in the immediate region of the injection well 65 and to also burn the cracking residue binding the catalyst thereby freeing the regenerated catalyst so that said flowing injection gases 68 may pick up the regenerated catalyst and deliver it along with currently injected catalyst to a hydrocarbon containing location farther downstream within said strata 1 in order to repeat the catalytic hydrocarbon cracking, thereby advancing active zone AB of the process through said strata 1 from said injection well 65 to the production well 66.

C. Initiation by inert gas heating of hydrocarbons followed by spontaneous combustion of hydrocarbons upon introducing $O_2$ containing gas. Referring to FIG. 1 gas analysis controller 16 set for inert gas operation opens inert gas control valve 14 and closes air intake control valve 15. Compressor 19 delivers pressurized inert gas to the furnace 30 which heats the inert gas to the temperature required for injection and heating hydrocarbon bearing strata 1. Introducing under pressure inert injection gases 68 flowing downwardly through tubing 50 extending through casing 53 in the injection well 65, injection tubing slotted section 56, and perforations 5 into said oppositely opposed hydrocarbons bearing porous and permeable strata 1 to preheat the immediate area of said hydrocarbon bearing strata 1 and the contained hydrocarbons to a temperature level sufficient to bring about a spontaneous ignition of the hydrocarbons in place when the $O_2$ content is raised in the injection gas; setting gas analysis controller 16 for $O_2$ containing gas operation opening air intake control valve 15 and closing inert gas control valve 14, thereby raising the $O_2$ content of said heated, pressuized injection gas 68 stream to a level suitable for initiating ignition and combustion of the previously preheated hydrocarbons within said strata 1 in the immediate region of said injection well 65; and introducing finely divided catalyst 79 particles into said heated, pressurized $O_2$ containing injection gas stream 68 such that said hot catalyst 79, carried through the burning hydrocarbon front by said injection gas 68 depleted of $O_2$ in passage thru the combustion zone, contacts heated hydrocarbons within said hydrocarbon bearing porous and permeable strata 1 thereby establishing a catalytic cracking zone by bringing about the catalytic cracking of the heavier molecular weight hydrocarbons into lighter molecular weight more flowable hydrocarbon reaction products and the catalytic cracking co-products of coke on catalyst and cracking residue.

D. Initiation by introducing hot $O_2$ containing gas for purposes of bringing about spontaneous combustion of hydrocarbons. Referring to FIG. 1 gas analysis controller 16 set for $O_2$ containing gas operation opens air intake control valve 15 and closes inert gas control valve 14. Compressor 19 delivers pressurized $O_2$ containing gas to furnace 30 which heats the gas to the temperature required for injection and bringing about spontaneous combustion of the hydrocarbons found in the strata 1 in the proximity of the injection well 65. Introducing under pressure heated $O_2$ containing injection gases 68 flowing downwardly through tubing 50 extending through casing 53 in the injection well 65, injection tubing slotted section 56 and perforations 5 into said oppositely opposed hydrocarbon bearing porous and permeable strata 1 to preheat the immediate area of said hydrocarbon bearing strata 1 and contained hydrocarbons to a temperature level to bring about spontaneous combustion of the hydrocarbons in place; and introducing finely divided catalyst 79 particles into said heated, pressurized $O_2$ containing injection gas stream 68 such that said hot catalyst 79, carried through the burning hydrocarbon front by said injection gas 68 depleted of $O_2$ in flowing thru the burning zone, contacts heated hydrocarbons in place within said hydrocarbon bearing porous and permeable strata 1 thereby establishing a catalytic cracking zone by bringing about the catalytic cracking of the heavier molecular weight hydrocarbons into lighter molecular weight more flowable hydrocarbon reaction products and the catalytic cracking coproducts of coke on catalyst and cracking residue.

E. Initiation by introducing $O_2$ containing gas and fuel gas through the injection well, using an ignitor system to fire the fuel gas bringing about combustion of the hydrocarbons. Referring to FIG. 1 gas analysis controller 16 set for $O_2$ containing gas operation opens air intake control valve 15 and closes inert gas control valve 14. Compressor 19 delivers pressurized $O_2$ containing gas to furnace 30 which heats the gas to a temperature suitable for injection. Introducing heated and pressuirzed $O_2$ containing injection gas 68 to strata 1 via opened annulus flow back valve 35, tubing-casing annulus 70, opened adjustable packer 55; closing mix drum outlet block valve 46 and introducing fuel gas 47 via injection well tubing manifold 48, injection tubing 50 and tubing slotted section 56 oppositely opposed hydrocarbon bearing strata 1; activating the ignitor system 76 by opening fuel gas valve 58, air valve 59, ignitor tube block valve 61 and activating high voltage ignitor 75, the ignitor tube 57 extends downwardly through injection well tubing 50 and bottoms oppositely opposed injection tubing slotted section 56; ignition of said fuel gas 47 flowing from said tubing slotted section 56 converts the slotted section into a burner which under condition of excess air brings about combustion of the hydrocarbons within the strata 1 adjacent the injection well 65; once in-strata combustion of hydrocarbons is established fuel gas 47 flow through said tubing 50 is replaced with hot $O_2$ containing gas 68 after first purging the fuel gas from said injection tubing 50 with an inert gas 77 for safety purposes, $O_2$ containing gas flow through said annulus 70 is stopped and heating of the strata 1 is continued by in place burning of hydrocarbons; and after heating strata 1 adjacent the injection well 65 to a temperature suitable for initiating and establishing catalytic cracking of hydrocarbons, injection of hydrocarbon cracking catalyst 79 is started, transported to said strata 1 by said $O_2$ containing injection gas 68 thereby establishing a catalytic hydrocarbon cracking zone.

F. Initiation by preheating with inert gas followed by introducing $O_2$ containing gas via the injection well annulus and fuel gas via the injection well tubing and igniting the fuel gas with an ignitor extending downwardly through said annulus and bottoming oppositely opposed said slotted tubing section. Referring to FIG. 1 gas analysis controller 16 set for inert gas operation opens inert gas control valve 14 and closes air intake control valve 15. Compressor 19 delivers pressurized inert gas to furnace 30 which heats the gas to a temperature suitable for injection via injection well 65 to hydrocarbon bearing strata 1. Introducing under pressure heated inert injection gases 68 downwardly into and through tubing 50, slotted tubing section 56 and perforations 5 extending through casing 53 into oppositely opposed said hydrocarbon bearing strata 1; setting gas analysis controller 16 for $O_2$ containing gas operation thereby opening air intake valve 15, lining up fuel gas 47 to the injection well tubing 50, lining up $O_2$ containing injection gas 68 through the injection well annulus 70 via opened annulus flow block valve 35 and activating annulus positioned ignitor system 76 shown in FIG. 2 by opening ignitor fuel gas valve 58 and air valve 59 and activating high voltage ignitor 75 thereby igniting the fuel gas 47 flowing from the slotted tubing section 56 effectively producing a fuel gas fired burner which under conditions of excess air available from the casing annulus 70 brings about burning of the hydrocarbons in said strata 1 in the immediate region of said injection well 65; shutting down fuel gas 47 flow through the injection well tubing 50, purging the tubing with an inert gas 77 for safety reasons, and opening valve 46 to establish flow of hot $O_2$ containing gas through said tubing 50 to support the in place burning of hydrocarbons located within said strata 1 in the immediate region of the injection well 65, closing annulus flow block valve 35 to shut down flow through the annulus 70; and starting catalyst particles 79 injection carried by the $O_2$ containing injection gases 68 flowing through said tubing 50, through said slotted tubing section 56 and said casing 53, perforation 5 into said hydrocarbon bearing strata 1 flowing past the in-place hydrocarbon burning front within the strata 1 thereby delivering hot catalyst 79 transported by injection gas depleted of $O_2$ in flowing through the combustion zone to heated hydrocarbons and establishing a catalytic hydrocarbon cracking zone and, G. Initiation by introducing $O_2$ containing gas via injection well annulus, fuel gas via the injection well tubing and igniting the fuel gas with an ignitor extending downwardly through said annulus and bottoming oppositely opposed said slotted tubing section as shown in FIG. 2. Referring to FIG. 1 gas analysis controller 16 set for $O_2$ containing gas operation opens air intake control valve 15 and closes inert gas control valve 14. Compressor 19 delivers pressurized inert gas to furnace 30 which heats the gas to a temperature suitable for injection into hydrocarbon bearing strata 1. Introducing heated and pressurized $O_2$ containing injection gas 68 to said strata 1 via opened annulus flow block valve 35, tubing-casing annulus 70; closing mix drum outlet block valve 46 and introducing fuel gas 47 via injection well tubing manifold 48, injection tubing 50 and tubing slotted section 56 oppositely opposed hydrocarbon bearing strata 1; referring to FIG. 2 activating the ignitor system 76 by opening fuel gas valve 58, air valve 59, ignitor tube block valve 61 and activating high voltage ignitor 75, ignitor tube 57 extends downwardly through injection well annulus 70 and bottoms oppositely opposed injection tubing slotted section 56; ignition of the fuel gas flowing from the tubing slotted section converts the slotted section into a burner which under condition of excess air brings about the combustion of the hydrocarbons within said strata 1 adjacent the injection well 65; referring to FIG. 1 once in strata combustion of hydrocarbons is established fuel gas 47 flow through the tubing 50 is replaced with hot $O_2$ containing gas flow after purging the fuel gas from the tubing with an inert gas 77 for safety purposes, $O_2$ containing gas flow through the annulus 70 is stopped and heating of the strata 1 is continued by in place burning of hydrocarbons; and after heating strata 1 adjacent the injection well 65 to a temperature suitable for initiating and establishing catalytic cracking of hydrocarbons, injection of hydrocarbon cracking catalyst 79 is started, transported to said strata 1 by said $O_2$ containing injection gas 68 thereby establishing a catalytic hydrocarbon cracking zone.

Catalyst 79 used in the process of this invention shall be material having hydrocarbon cracking catalytic activity and capable of being regenerated by burning the deactivating deposits of coke which are formed on the catalyst surfaces as a coproduct in the hydrocarbon cracking reaction. This catalyst may be any of the catalyst varieties conventionally employed in fluid catalytic cracking units of the petroleum refining industry. For example, catalyst used are natural clay, synthetic clay, silica, alumina, mixtures of silica and alumina gels, mixtures of silica and alumina gels containing synthesized aluminosilicate zeolites. These crystalline aluminosilicate zeolites having a structure similar to the naturally occurring faujasite have rare earth metal ions such as zirconium substituted for a portion of the sodium ions located in the crystalline structure. Table 1, hereinafter shown, gives the chemical composition of a typical aluminosilicate zeolite hydrocarbon cracking catalyst.

TABLE I

| CHEMICAL ANALYSIS: wt. %. dry basis | |
|---|---|
| SILICA ($SiO_2$) | 66.3 |
| ALUMINA ($Al_2O_3$) | 28.6 |
| SODIUM OXIDE ($Na_2O$) | .57 |
| IRON (Fe) | .09 |
| LOSS ON IGNITION (1500° F.) | 12.9 |

Found in literature are many discussions of zeolite or molecular sieve hydrocarbon cracking catalyst. The following is a partial list of applicable references to molecular sieve cracking catalyst:

Baker et at., "Synthetic Foujasite — The Molecular Sieve for Fluid Cracking Catalyst" RM-67-77, Sept., 1967 — National Petroleum Refiners Association Pickert, P. E., "The Role of Molecular Sieves in Cracking Catalysts" 26 - 68, May, 1968 — American Petroleum Institue

Ebel, R. H., "Sieve Properties Can Yield Superior Cracking Catalysts", Apr., 1968 — The Oil and Gas Journal The size of the finely divided catalyst particles used in the process of this invention must meet two important criteria:

1. The catalyst particle must be sufficiently small to easily flow through the pore spaces of the hydrocarbon bearing earth strata to be produced, and
2. The terminal velocity of the finely divided catalyst particles must be sufficiently lower than the gas velocities experienced in the strata during operation of the process of the invention. For these reasons the size of the catalyst particles used in the process of this invention and the individual hydrocarbon bearing strata's geological data are carefully evaluated prior to initiation of the process. Catalyst sizing equipment such as that of Fluid Energy Co jet mill as shown and described in catalogue # M2 dated 5 M 74, are required in many applications of the process of this invention to produce submicron catalyst particles which approach EROWNIAN MOVEMENT flow characteristics.

In the case of aluminosilicate zeolite rare earth catalyst permanent deactivation or poisoning is caused by sodium ion contamination. For this reason pretreating of the strata with steam and/or deionized water is used to flush sodium ions away from the strata adjacent the injection well. The use of steam and/or deionized water which have extremely low Na + ion (sodium) concentration is critical to the successful pretreatment flushing of the hydrocarbon bearing strata. Referring to FIG. 1, techniques used to pretreat the strata are discussed below:

A. Pressurized deionized water 99 is lined up to the injection well tubing manifold 48 by opening deionized water valve 100. The deionized water flows down injection well tubing 50 and into and through strata 1 toward production well 66. Sodium content of produced water is analyzed to determine the duration of deionized water injection B. Steam 97 is lined up to the injection well tubing manifold 48 by opening steam valve 98. The steam flows down injection well tubing 50 and into and through strata 1 toward production well 66. Sodium content of produced water is analyzed to determine the duration of the steam displacement.

C. A combination technique of first injecting deionized water 99 into strata 1 followed by a steam 97 injection to displace sodium ions from the strata region to be catalytically produced.

Once the strata has been purposely wet with water or steam in pretreating, or, if geological data indicate, the placing of an initial catalyst charge into the strata by means of a catalyst slurry may be utilized. The catalyst slurry placement in the strata 1 is accomplished either after the deionized water flood, after the steam displacement or before the initial strata heatup step of initiating the process is begun.

Referring to FIG. 1, charging the strata 1 with a catalyst slurry is accomplished by the following steps:

Flowing finely divided catalyst particles 79 stored in catalyst storage bin 36 to catalyst lurrying mixer 40 using pressurized dry bulk feeder 39. Flowing slurring fluid 78 to the catalyst slurrying mixer via slurrying fluid flow measuring element 110 and flow control valve 41. Pumping the catalyst slurry to the injection well tubing manifold 48 using catalyst slurry pump 43 via slurry supply pipe 42 and block valve 101. The slurried catalyst flows downwardly through injection well tubing 50 through injection well casing and cement perforations 5 into the oppositely opposed hydrocarbon bearing strata 1.

The capability of delivering catalyst slurry from the slurrying mixer 40 to the mix drum 45 by the slurry pump 43 is available via pipe 42 and block valve 44. This permits the mixing of a catalyst slurry with hot injection gases both of which are delivered to strata 1 when dictated by the response of a particular strata/hydrocarbon system to the operation of the process of this invention.

Depending upon the response of the particular hydrocarbon reservoir system to the process of this invention, reference is here made to FIG. 1 wherein steam 97 may be introduced via valve 98 located on injection well manifold 48 into hot $O_2$ containing injection gas 68, with or without catalyst present. This admixture of steam and hot $O_2$ containing injection gas, with or without catalyst present, is then delivered under pressure into the hydrocarbon bearing strata 1.

Furthermore, depending upon the response of the particular hydrocarbon reservoir system to the process of this invention reference is here made to FIG. 1 wherein steam 97 may be introduced via valve 98 located on injection well manifold 48 into hot inert injection gas 68, with or without catalyst 79 present. This admixture of steam and hot inert gas, with or without catalyst present, is then delivered under pressure into the hydrocarbon strata 1.

In the operation of the process of this invention control of the strata 1 back pressure would be advantageous. Referring to FIG. 2, this is accomplished by operating the production well pumping unit 83 and production separator 84 off gas vacuum pump 85.

In the operation of the process of this invention by the structure herein provided, the response of the strata 1 may dictate the need to pulse or reverse flow in the strata for a short duration of time. Referring to FIG. 1, reverse flowing is accompolished by opening valve 103 allowing flow through atmospheric vent 102 located in communication with the injection well tubing manifold 48 thereby relieving the system pressure to atmosphere then resuming normal operations of the process of this invention.

An impervious material such as cement or the like, may be used to fill and seal the annulus between the casing 53 and the well bore 111 of the injection well in order to prevent invasion of undesired fluid flow above or below the hydrocarbon strata to be produced by the process of this invention, and, also to prevent the bypassing of the strata by said injection gases and catalyst introduced via the injection well to said strata 1.

It is understood, that a plurality of injection wells and a plurality of production wells may be arranged and positioned in various patterns to each other utilizing the processes of this invention to free in place hydrocarbons and recover the production of such freed hydrocarbons in said production wells. The use of one injection well and one production well throughout the description of this invention is used as an example only.

It is obvious that many changes may be made in the combination of parts and elements whereby my basic process may be accomplished as shown, described and claimed herein without departing from the spirit and scope of the invention.

Having thus described the invention, what I claim as new and desire to secure by Letters Patent, is:

1. In an apparatus used to perform the process of catalytic stimulation of hydrocarbon recovery from porous and permeable hydrocarbon bearing strata in earth formation having at least one injection well and at least one production well each including a casing set and cemented through the same porous and permeable hydrocarbon bearing strata and perforated oppositely said hydrocarbon bearing strata, a well head at the upper surface end of said casings, tubing extending through said well heads hermetically sealing the annulus between said tubing and said casing in said injection and production wells, said tubing extending downwardly through said casing in said wells, the lower ends of said tubing are slotted oppositely said casing perforations and said hydrocarbon bearing strata, an adjustable packer adjacent the slotted section of said tubing hermetically sealing said annulus between said tubing and said casing in said injection and production well, the upper ends of said tubing in said injection well in communication with a block valve, a tubing manifold in communication with said block valve, a fuel gas supply pipe, a tubular purge connection, a purge block valve, and a fuel gas block valve between said tubing manifold and said fuel gas supply pipe all in communication with each other, an ignitor system including an ignitor coupling at the upper end of said tubing manifold, an ignitor system retrieval block valve, an ignitor system packing gland all in communication with each other, a retrievable ignitor tube extending down through said ignitor system packing gland, ignitor system retrieval block valve, ignitor coupling, tubing manifold, tubing block valve, and tubing bottoming in said tubing slotted section, and ignitor tube block valve at the upper surface end of said ignitor tube, and an ignitor chamber all in communication with each other, a high voltage ignitor in communication with said ignitor chamber, a pressurized air supply pipe, a block valve and a pipe between said pressurized air supply pipe and said ignitor chamber, a pressurized fuel gas supply pipe, a block valve and a pipe between said pressurized fuel gas supply pipe and said ignitor chamber all in communication with each other, a fired furnace outlet manifold and said injection well tubing-casing annulus all in communication with each other means delivering air downwardly through said tubing-casing annulus flowing past said open adjustable packer, means delivering fuel gas downwardly through said injection well tubing, and means activating said ignitor system, causing said slotted tubing section to fire similar to a burner under conditions of excess air, whereby combustion of said hydrocarbons found in said porous and permeable hydrocarbon bearing strata in the immediate region of said injection well is effected, a mix drum in communication with said tubing manifold, a compressor supplying pressurized hot injection gases under pressure through a pipe to said mix drum and mixing said hot gases with the catalyst delivered to said mix drum, a pressurized catalyst storage bin in communication with said mix drum and having a pressurized dry bulk feeder between said catalyst storage bin and said mix drum, said pressurized dry bulk feeder feeding catalyst into said mix drum and into said pressurized hot gases entering said mix drum thereby mixing said hot gases and catalyst which concurrently flow through said tubing manifold, tubing block valve, injection well tubing, tubing slots, casing and cement perforations into said oppositely disposed hydrocarbon in place in said strata, a compressor having a compressor discharge knock out drum, furnace convection section and radiant section coils, a furnace outlet manifold, furnace outlet temperature sensing element, a furnace outlet header and a furnace outlet header block valve between said compressor and said mix drum all in communication with each other, a compressor suction manifold, a gas analysis sensing element and compressor suction header between said compressor and said compressor suction manifold all in communication with each other, an inert gas supply pipe having an inert gas cooler, an inert gas liquid knock out drum, an inert gas control valve between said compressor suction manifold and said inert gas supply pipe all in communication with each other, a furnace burner, a furnace firebox, a furnace stack convection section and a stack opening between said furnace burner and said inert gas supply pipe all in communication with each other, whereby fired furnace flue gases may be used as a source of inert injection gas for the production of this invention, an atmospheric air suction pipe, an air intake control valve between said atmospheric air suction pipe and said compressor suction manifold all in communication with each other, whereby heated, pressurized $O_2$-containing gas may be injected into the strata for purposes of initiating the process or for in place catalyst regeneration within the strata for the process of this invention, an $O_2$ supply pipe, a block valve between said $O_2$ supply pipe and said compressor suction manifold all in communication with each other, a non-flue inert gas supply pipe and said compressor suction manifold all in communication with each other, whereby any suitable $O_2$ content or type of inert gas is made available for injection into the hydrocarbon bearing strata in the process of this invention, a fuel supply pipe in communication with said furnace burner and having a temperature control valve between said fuel supply pipe and said fuel burner, a temperature controller in communication with said temperature control valve and said furnace outlet temperaturesensing element whereby the furnace outlet temperature of the pressurized injection gas is controlled at the desired level, a catalyst slurry pipe and a block valve between said catalyst slurry supply pipe and said injection well tubing manifold all in communication with each other, a catalyst storage bin, a catalyst slurry pump, a catalyst slurrying mixer and a dry bulk feeder between said catalyst storage bin and said catalyst slurry supply pipe all in communication with each other, a catalyst slurrying fluid supply pipe and a flow control valve and a flow measuring element between said catalyst slurrying fluid supply pipe and said catalyst slurrying mixer all in communication with each other, whereby said catalyst slurry is injected into said hydrocarbon strata in the process of this invention, a deionized water supply pipe, a block valve between said deionized water supply pipe and said injection well tubing manifold, a steam supply pipe and a block valve between said injection well tubing manifold and said steam supply pipe all in communication with each other whereby said deionized water and said steam are injected into said hydrocarbon bearing strata in order to displace salts which poison or deactivate said hydrocarbon cracking catalyst injected into said strata in the process of this invention, a pumping unit extending downwardly through said production well tubing adjacent said slotted section of said production tubing, a production tubing manifold located at the surface above said well head and having a block valve between said production tubing manifold and said production well tubing, a compressor suction having a block valve, a separator inlet header and a production separator and a compressor suction header and block valve between said compressor suction and said production tubing manifold all in communication with each other, whereby a suitable level of back pressure may be held on the hydrocarbon bearing strata by the manner of operation of said production well equipment in the process of this invention, insulation covering the outer wall of said injection well tubing located in the casing whereby annulus heat losses from said hot injection gases are minimized in the process of this invention, the upper end of said injection well tubing, a block valve, an injection well tubing manifold, a mix drum outlet block valve and a furnace outlet manifold between said upper end of injection well tubing and said furnace outlet header all in communication with each other and covered with insulation whereby heat losses from hot injection gases are minimized in the process of this invention as safe and efficient operations dictate, an atmospheric vent, a vent block valve and a vent connection between said atmospheric vent and said injection well tubing manifold all in communication with each other, whereby said hydrocarbon bearing porous and permeable strata is reverse flowed and pulsed in the process of this invention when reservoir response dictates.

2. In an apparatus used to perform the process of catalytic stimulation of hydrocarbon recovery from porous and permeable hydrocarbon bearing strata in earth formations having at least one injection well and at least one production well each including a casing set and cemented through the same porous and permeable hydrocarbon bearing strata and perforated oppositely said hydrocarbon bearing strata, a well head at the upper surface end of said casings, tubing extending through said well heads hermetically sealing the annulus between said tubing and said casing in said injection and production wells, said tubing extending downwardly through said casing in said wells, the lower ends of said tubing are slotted oppositely said casing perforations and said hydrocarbon bearing strata, an adjustable packer adjacent the slotted section of said tubing hermetically sealing said annulus between said tubing and said casing in said injection and production wells, the upper end of said tubing in said injection well in communication with a block valve, a tubing manifold in communication with said block valve, a mix drum in communication with said tubing manifold, a compressor supplying pressurized hot injection gases under pressure through a pipe to said mix drum, a pressurized catalyst storage bin in communication with said mix drum and having a pressurized dry bulk feeder between said catalyst storage bin and said mix drum, said pressurized dry bulk feeder feeding catalyst into said mix drum and into said pressurized hot gases entering said mix drum thereby mixing said hot gases and catalyst which admixture flows through said tubing manifold, tubing block valve, injection well tubing, tubing slots, casing and cement perforations into said oppositely disposed hydrocarbon bearing strata for catalytically cracking said hydrocarbon in place in said strata.

3. In an apparatus used to perform the process of catalytic stimulation of hydrocarbon recovery from porous and permeable hydrocarbon bearing strata in earth formations having at least one injection well and at least one production well each including a casing set and cemented through the same porous and permeable hydrocarbon bearing strata and perforated oppositely said hydrocarbon bearing strata, a well head at the upper surface end of said casings, tubing extending through annulus between said tubing and said casing in said injection and production wells, said tubing extending downwardly through said casing in said wells, the lower end of said tubing are slotted oppositely said casing perforations and said hydrocarbon bearing strata, an adjustable packer adjacent the slotted sections of said tubing hermetically sealing said annulus between said tubing and said casing in said injection and production wells, the upper end of said tubing in said injection well in communication with a block valve, a tubing manifold in communication with said block valve, a mix drum in communication with said tubing manifold, a compressor, a compressor discharge knock out drum, furnace convection coils, furnace radiant coils, furnace outlet manifold, furnace oulet temperature sensing element and a furnace outlet header block valve between said compressor and said mix drum all in communication with each other, a compressor suction manifold having a gas analysis sensing element and a compressor suction header all in communication with said compressor and an atmospheric air suction pipe having an air intake control valve between said atmospheric air suction and said compressor suction manifold all in communication with each other, an inert gas supply pipe, an inert gas cooler, an inert gas liquid knock out drum, an inert gas knock out drum and an inert gas control valve between said compressor suction manifold and said inert gas supply pipe all in communication with each other, a fired furnace firebox, a stack section and stack opening between said fired furnace firebox and said inert gas supply pipe all in communication with each other, a gas analysis controller in communication with said gas analysis sensing element, said air intake control valve and said inert gas control valve, whereby fired furnace stack gases may be used as a source of inert injection gas or as a means of controlling the $O_2$ content of the injection gas at a composition less than that of air.

4. In an apparatus used to perform the process of catalytic stimulation of hydrocarbon recovery from porous and permeable hydrocarbon bearing strata in earth formations having at least one injection well and at least one production well each including a casing set and cemented through the same porous and permeable hydrocarbon bearing strata and perforated oppositely said hydrocarbon bearing strata, a well head at the upper surface end of said casings, tubing extending through annulus between said tubing and said casing in said injection and production well, said tubing extending downwardly through said casing in said wells, the lower ends of said tubing are slotted oppositely said casing perforations and said hydrocarbon bearing strata, an adjustable packer adjacent the slotted sections of said tubing hermetically sealing said annulus between said tubing and said casing in said injection and production well, the upper ends of said tubing in said injection well in communication with a block valve, a tubing manifold in communication with said block valve, a fuel gas supply pipe, tubular purge connection, a purge block valve and a fuel gas block valve between said tubing manifold and said fuel gas supply pipe all in communication with each other, an ignitor system including an ignitor coupling at the upper end of said tubing manifold, an ignitor system retrieval block valve and an ignitor system packing gland all in communication with each other, a retrievable ignitor tube extending down through said ignitor system packing gland, ignitor system retrieval block valve, ignitor coupling, tubing manifold, tubing block valve, and tubing, bottoming in said tubing slotted section, an igniter tube block valve at the upper surface end of said ignitor tube and an ignitor chamber all in communication with each other, a high voltage ignitor in communication with said ignitor chamber, a pressurized air supply pipe, a block valve and a pipe between said pressurized air supply pipe and said ignitor chamber, a pressurized fuel gas supply pipe and said ignitor chamber all in communication with each other, a fired furnace oulet manifold, a well head connection, a block valve and pipe between said fired furnace outlet manifold and said injection well tubing-casing annulus all in communication with each other, means delivering air downwardly through said tubingcasing annulus flowing past said open adjustable packer, means delivering fuel gas downwardly through said injection well tubing, and means activating said ignitor system, causing said slotted tubing section to fire similar to a burner under conditions of excess air, whereby combustion of said hydrocarbons found in said porous and permeable hydrocarbon bearing strata in the immediate region of said injection well is effected.

5. In an apparatus used to perform the process of catalytic stimulation of hydrocarbon recovery from porous and permeable hydrocarbon bearing strata in earth formations having at least one injection well and at least one production well each including a casing set and cemented through the same porous and permeable hydrocarbon bearing strata and perforated oppositely said hydrocarbon bearing strata, a well head at the upper surface end of said casings, tubing extending through said well heads hermetically sealing the annulus between said tubing and said injection and production wells, said tubing extending downwardly through said casing in said wells, the lower end of said tubing are slotted oppositely said casing perforations and said hydrocarbon bearing strata, an adjustable packer adjacent between the slotted section of said tubing hermetically sealing said annulus between said tubing and said casing in said injection and production wells, the upper end of said tubing in said injection well in communication with a block valve, a tubing manifold in communication with said block valve, a mix drum in communication with said tubing manifold, a compressor supplying pressurized hot injection gases under pressure through a pipe to said mix drum, furnace radiant section coils, a temperature control sensing element a furnace outlet manifold, furnace outlet header, and furnace outlet block valve between said furnace radiant section coils and said mix drum all in communication with each other, a fired furnace firebox surrounding said furnace radiant section coils, a fuel burner in communication with said firebox and a fuel supply pipe having a connecting pipe and a temperature control valve between said fuel burner and said fuel pipe all in communication with each other, a temperature controller in communication with said temperature control sensing element and said temperature control valve, whereby the furnace outlet temperature of the pressurized injection gas may be controlled at the desired level, a furnace convection section stack in communication with said furnace firebox and containing furnace convection section coils, a stack opening in said furnace stack adjacent said convection section heating coils in communication with said compressor, a damper located in said furnace stack above said stack opening, furnace radiant section coils in communication with said furnace convection section coils, a discharge knockout outlet pipe, a discharge knockout drum and a compressor discharge header between said furnace convection section coils and said compressor all in communication with each other, whereby the compressor delivers pressurized inert gas to the furnace convection and radiant section coils where the desired injection gas temperature is achieved and controlled.

6. In an apparatus used to perform the process of catalytic stimulation of hydrocarbon recovery from porous and permeable hydrocarbon bearing strata in earth formations having at least one injection well and at least one production well each including a casing set and cemented through the same porous and permeable hydrocarbon bearing strata and perforated oppositely said hydrocarbon bearing strata, a well head at the upper surface end of said casings, tubing extending through said well heads hermetically sealing the annulus between said tubing and said casing in said injection and production wells, said tubing extending downwardly through said casing in said wells, the lower ends of said tubing are slotted oppositely said casing perforations and said hydrocarbon bearing strata, an adjustable packer adjacent the slotted section of said tubing hermetically sealing said annulus between said tubing and said casing in said injection and production wells, the upper end of said tubing in said injection well in communication with a block valve, a tubing manifold in communication with said block valve, a mix drum in communication with said tubing manifold, a compressor having a compressor discharge knock out drum, furnace convection section coils, furnace radiant section coils, a furnace outlet manifold, furnace outlet temperature sensing element, a furnace outlet header and a furnace outlet header block valve between said compressor and said mix drum all in communication with each other, a compressor suction manifold, a gas analysis sensing element and compressor suction header between said compressor and said compressor suction manifold all in communication with each other, an inert gas supply pipe having an inert gas cooler, an inert gas liquid knock out drum and an inert gas control valve between said compressor suction manifold and said inert gas supply pipe all in communication with each other, a furnace burner, a furnace firebox, a furnace stack convection section and a stack opening between said furnace burner and said inert gas supply pipe all in communication with each other, whereby fired furnace flue gases may be used as a source of inert injection gas for the process of this invention.

7. In an apparatus used to perform the process of catalytic stimulation of hydrocarbon recovery from porous and permeable hydrocarbon bearing strata in earth formation having at least one injection well and at least one production well each including a casing set and cemented through the same porous and permeable hydrocarbon bearing strata and perforated oppositely said hydrocarbon bearing strata, a well head at the upper surface end of said casings, tubing extending through said well heads hermetically sealing the annulus between said tubing and said casing in said injection and production wells, said tubing extending downwardly through said casing in said wells, the lower ends of said tubing are slotted oppositely said casing perforations and said hydrocarbon bearing strata, an adjustable packer adjacent the slotted section of said tubing hermetically sealing said annulus between said tubing and said casing in said injection and production wells, the upper end of said tubing in said injection well in communication with a block valve, a tubing manifold in communication with said block valve, a mix drum in communication with said tubing manifold, a compressor, a compressor discharge knock out drum, furnace convection section coils, furnace radiant section coils, a furnace outlet manifold, furnace outlet temperature-sensing element, a furnace outlet header and a furnace outlet header block valve between said compressor and said mix drum and all in communication with each other, a compressor suction manifold, a gas analysis sensing element and compressor suction header between said compressor suction manifold and said compressor all in communication with each other, an atmospheric air suction pipe and an air intake control valve between said atmospheric air suction pipe and said compressor suction manifold all in communication with each other, whereby heated pressurized $O_2$-containing gas may be injected into the strata for purposes of initiating the process for regenerating catalyst in place within the strata in the process of this invention.

8. In an apparatus used to perform the process of catalytic stimulation of hydrocarbon recovery from porous and permeable hydrocarbon bearing strata in earth formations having at least one injection well and at least one production well each including a casing set and cemented through the same porous and permeable hydrocarbon bearing strata and perforated oppositely said hydrocarbon bearing strata, a well head at the upper end of said casings, tubing extending through said well heads hermetically sealing the annulus between said tubing and said casing in said injection and production wells, said tubing extending downwardly through said casing in said wells, the lower ends of said tubing are slotted oppositely said casing perforations and said hydrocarbon bearing strata, an adjustable packer adjacent the slotted section of said tubing hermetically sealing said annulus between said tubing and said casing in said injection and production wells, the upper end of said tubing in said injection well in communication with a block valve, a tubing manifold in communication with said block valve, a hydrocarbon cracking catalyst slurry supply pipe with block valve, a deionized water supply pipe and a block valve all in communication with said injection well tubing manifold, whereby said deionized water may be injected into said hydrocarbon bearing strata in order to displace salts which poison or deactivate the catalysts injected into said strata in the process of this invention.

9. In an apparatus used to perform the process of catalytic stimulation of hydrocarbon recovery from porous and permeable hydrocarbon bearing strata in earth formations having at least one injection well and at least one production well each including a casing set and cemented through the same porous and permeable hydrocarbon bearing strata and perforated oppositely said hydrocarbon bearing strata, a well head at the upper surface end of said casings, tubing extending through said well heads hermetically sealing the annulus between said tubing and said casing in said injection and production wells, said tubing extending downwardly through said casing in said wells, the lower ends of said tubing are slotted oppositely said casing perforations and said hydrocarbon bearing strata, an adjustable packer adjacent the slotted section of said tubing hermetically sealing said annulus between said tubing and said casing in said injection and production wells, the upper end of said tubing in said injection well in communication with a block valve, a tubing manifold in communication with said block valve, a catalyst slurry supply pipe and a block valve between said catalyst slurry supply pipe and said injection well tubing manifold all in communication with each other, a catalyst storage bin, a catalyst slurry pump, a catalyst slurrying mixer and a dry bulk feeder between said catalyst storage bin and said catalyst slurry supply pipe all in communication with each other, a catalyst slurrying fluid supply pipe, a flow control valve and a flow measuring element between said catalyst slurrying fluid supply pipe and said catalyst slurrying mixer all in communication with each other, whereby said catalyst slurry is injected into said hydrocarbon strata in the process of this invention.

10. In an apparatus used to perform the process of catalytic stimulation of hydrocarbon recovery from porous and permeable hydrocarbon bearing strata in earth formations having at least one injection well and at least one production well each including a casing set and cemented through the same porous and permeable hydrocarbon bearing strata and perforated oppositely said hydrocarbon bearing strata, a well head at the upper surface end of said casings, tubing extending through said well heads hermetically sealing the annulus between said tubing and said casing in said injection and production wells, said tubing extending downwardly through said casing in said wells, the lower ends of said tubing are slotted oppositely said casing perforations and said hydrocarbon bearing strata, an adjustable packer adjacent the slotted section of said tubing hermetically sealing said annulus between said tubing and said casing in said injection and production wells, the upper end of said tubing in said injection well in communication with a block valve, a tubing manifold in communication with said block valve, a deionized water supply pipe with a block valve, a hydrocarbon cracking catalyst slurry supply pipe with block valve and a steam supply pipe and a block valve all in communication with said injection well tubing manifold whereby said deionized water and said steam are injected into said hydrocarbon bearing strata in order to displace salts which poison or deactivate said hydrocarbon cracking catalyst injected into said strata in the process of this invention.

11. In an apparatus used to perform the process of catalytic stimulation of hydrocarbon recovery from porous and permeable hydrocarbon bearing strata in earth formations having at least one injection well and at least one production well each including a casing set and cemented through the same porous and permeable hydrocarbon bearing strata and perforated oppositely said hydrocarbon bearing strata, a well head at the upper surface end of said casings, tubing extending through said well heads hermetically sealing the annulus between said tubing and said casing in said injection and production wells, said tubing extending downwardly through said casing in said wells, the lower ends of said tubing are slotted oppositely said casing perforations and said hydrocarbon bearing strata, an adjustable packer adjacent the slotted section of said tubing hermetically sealing said annulus between said tubing and said casing in said injection and production wells, the upper end of said tubing in said injection well in communication with a block valve, a tubing manifold in communication with said block valve, a steam supply pipe and a block valve and a hydrocarbon cracking catalyst slurry supply pipe with block valve all in communication with said injection tubing manifold, whereby said steam is injected into said hydrocarbon bearing strata in order to displace salts which poison or deactivate the catalyst injected into said strata in the process of this invention.

12. In an apparatus used to perform the process of catalytic stimulation of hydrocarbon recovery from porous and permeable hydrocarbon bearing strata in earth formations having at least one injection well and at least one production well each including a casing set and cemented through the same porous and permeable hydrocarbon bearing strata and perforated oppositely said hydrocarbon bearing strata, a well head at the upper surface end of said casings, tubing extending through said well heads hermetically sealing the annulus between said tubing and said casing in said injection and production wells, a hydrocarbon cracking catalyst slurry pipe in communication with upper end of said injection well tubing, said tubing extending downwardly through said casing in said wells, the lower ends of said tubing are slotted oppositely said casing perforations and said hydrocarbon bearing strata, an adjustable packer adjacent the slotted section of said tubing hermetically sealing said annulus between said tubing and said casing in said injection and production wells, a pumping unit extending downwardly through said production well tubing adjacent said slotted section of said production tubing, a production tubing manifold located at the surface above said well head and having a block valve between said production tubing manifold and said production well tubing, a production separator off gas suction pump having a suction block valve, a separator inlet header, a production separator and a production off gas suction header and block valve between said off gas vacuum pump and said production tubing manifold all in communication with each other, whereby a suitable level of back pressure may be held on the hydrocarbon bearing strata by the manner of operation of said production well equipment in the process of this invention.

13. In an apparatus used to perform the process of catalytic stimulation of hydrocarbon recovery from porous and permeable hydrocarbon bearing strata in earth formations having at least one injection well and at least one production well each including a casing set and cemented through the same porous and permeable hydrocarbon bearing strata and perforated oppositely said hydrocarbon bearing strata, a well head at the upper surface end of said casings, tubing extending through said well heads hermetically sealing the annulus between said tubing and said casing in said injection and production wells, said tubing extending downwardly through said casing in said wells, the lower ends of said tubing are slotted oppositely said casing perforations and said hydrocarbon bearing strata, an adjustable packer adjacent the slotted section of said tubing hermetically sealing said annulus between said tubing and said casing in said injection well in communication with a block valve, a tubing manifold in communication with said block valve, a mix drum in communication with said tubing manifold, a compressor, a compressor discharge knock out drum, furnace convection section coils, furnace radiant section coils, a furnace outlet manifold, furnace outlet temperature-sensing element, a furnace outlet header and a furnace outlet header block valve between said compressor and said mix drum all in communication with each other, a compressor suction manifold, a gas analysis sensing element and a compressor suction header between said compressor suction manifold and said compressor all in communication with each other, an $O_2$ supply pipe and a block valve between said $O_2$ supply pipe and said compressor suction manifold all in communication with each other, a non-flue inert gas supply pipe and a block valve between said non-flue inert gas supply pipe and said compressor suction manifold all in communication with each other, whereby any suitable $O_2$ content or type of inert gas is made available for injection into the hydrocarbon bearing strata in the process of this invention.

14. In an apparatus used to perform the process of catalytic stimulation of hydrocarbon recovery from porous and permeable hydrocarbon bearing strata in earth formations having at least one injection well and at least one production well each including a casing set and cemented through the same porous and permeable hydrocarbon bearing strata and perforated oppositely said hydrocarbon bearing strata, a well head at the upper surface end of said casings, tubing extending through said well heads hermetically sealing the annulus between said tubing and said casing in said injection and production wells, said tubing extending downwardly through said casing in said wells, the lower ends of said tubing are slotted oppositely said casing perforations and said hydrocarbon bearing strata, an adjustable packer adjacent the slotted section of said tubing hermetically sealing said annulus between said tubing and said casing in said injection and production wells, insulation covering the outer wall of said injection well tubing located in the casing whereby annulus heat losses from said hot injection gases are minimized in the process of this invention, the upper end of said injection well tubing, a block valve, injection well tubing manifold, a mix drum outlet block valve, a mix drum and a furnace outlet header a furnace outlet header block valve, a furnace outlet manifold between said upper end of injection well tubing and said furnace outlet header all in communication with each other and covered with insulation whereby heat losses from hot injection gases are minimized in the process of this invention as safe and efficient operations dictate, a hydrocarbon cracking catalyst slurry pump, a slurry supply pipe, a slurry block valve and said mix drum all in communication with each other whereby a hydrocarbon cracking catalyst slurry is injected into said hot pressurized injection gas stream delivered to said hydrocarbon bearing strata in the process of this invention.

15. In an apparatus used to perform the process of catalytic stimulation of hydrocarbon recovery from porous and permeable hydrocarbon bearing strata in earth formations having at least one injection well and at least one production well each including a casing set and cemented through the same porous and permeable hydrocarbon bearing strata and perforated oppositely said hydrocarbon bearing strata, a well head at the upper surface end of said casings, tubing extending through said well heads hermetically sealing the annulus between said tubing and said casing in said injection and production wells, said tubing extending downwardly through said casing in said wells, the lower ends of said tubing are slotted oppositely said casing perforations and said hydrocarbon bearing strata, an adjustable packer adjacent the slotted section of said tubing hermetically sealing said annulus between said tubing and said casing in said injection and production wells, the upper end of said tubing in said injection well in communication with a block valve, a tubing manifold in communication with said block valve, an atmospheric vent, a vent block valve and a vent connection between said atmospheric vent and said injection well tubing manifold all in communication with each other, whereby said hydrocarbon bearing porous and permeable strata is reverse flowed and pulsed in the process of this invention when reservior response dictates.

16. In an apparatus used to perform the process of catalytic stimulation of hydrocarbon recovery from porous and permeable hydrocarbon bearing strata in earth formations having at least one injection well and at least one production well each including a casing set and cemented through the same porous and permeable hydrocarbon bearing strata and perforated oppositely said hydrocarbon bearing strata, a well head at the upper surface end of said casings, tubing extending through said well heads hermetically sealing the annulus between said tubing and said casing in said injection and production wells, said tubing extending downwardly through said casing in said wells, the lower ends of said tubing are slotted oppositely said casing perforations and said hydrocarbon bearing strata, the upper end of said tubing in said injection well in communication with a block valve, a tubing manifold in communication with said block valve, a fuel gas supply pipe, a tubular purge connection, a purge block valve, and a fuel gas block valve between said tubing manifold and said fuel gas supply pipe all in communication with each other, an ignitor system including an ignitor coupling at the upper end of said injection well head, an ignitor system retrieval block valve and ignitor system packing gland all in communication with each other, a retrievable ignitor tube extending down through said ignitor system packing gland, ignitor system retrieval block valve, ignitor coupling, injection well head and said tubing-casing annulus, bottoming oppositely opposed said tubing slotted section, an ignitor tube block valve at the upper surface end of said ignitor tube, and an ignitor chamber all in communication with each other, a high voltage ignitor in communication with said ignitor chamber, a pressurized air supply pipe, a block valve and a pipe between said pressurized air supply pipe and said ignitor chamber, a pressurized fuel gas supply pipe, a block valve and a pipe between said pressurized fuel gas supply pipe and said ignitor chamber all in communication with each other, a furnace outlet manifold, a well head connection, a block valve and pipe between said fired furnace outlet manifold and said injection well tubing-casing annulus all in communication with each other, means delivering fuel gas downwardly through said injection well tubing, and means activating said ignitor system, causing said slotted tubing section to fire similar to a burner under conditions of excess air, whereby combustion of said hydrocarbons found in said porous and permeable hydrocarbon bearing strata in the immediate region of said injection well is effected.

17. In an apparatus used to perform the process of catalytic stimulation of hydrocarbon recovery from porous and permeable hydrocarbon bearing strata in earth formations having at least one injection well and at least one production well each including a casing set and cemented through the same porous and permeable hydrocarbon bearing strata and perforated oppositely said hydrocarbon bearing strata, a well head at the upper surface end of said casings, tubing extending through said well heads hermetically sealing the annulus between said tubing and said casing in said injection and production wells, said tubing extending downwardly through said casing in said wells, the lower ends of said tubing are slotted oppositely said casing perforations and said hydrocarbon bearing strata, an adjustable packer adjacent the slotted section of said tubing hermetically sealing said annulus between said tubing and said casing in said injection and production wells, the upper end of said injection well tubing in communication with said block valve, a steam supply pipe, a block valve between said steam supply pipe and injection well tubing manifold, a deionized water supply pipe, a block valve between said deionized water supply pipe and said injection well tubing manifold, catalyst slurry supply pipe and a block valve between said catalyst slurry supply pipe and said injection well tubing manifold all in communication with each other, whereby said deionized water and said steam are injected into said hydrocarbon bearing porous strata to displace salts which poison said hydrocarbon cracking catalyst and to inject hydrocarbon cracking catalyst slurry into said hydrocarbon bearing strata in the process of this invention.

18. In an apparatus used to perform the process of catalytic stimulation of hydrocarbon recovery from porous and permeable hydrocarbon bearing strata in earth formations having at least one injection well and at least one production well each including a casing set and cemented through the same porous and permeable hydrocarbon bearing strata and perforated oppositely said hydrocarbon bearing strata, a well head at the upper surface end of said casings, tubing extending through said well heads hermetically sealing the annulus between said tubing and said casing in said injection and production wells, said tubing extending downwardly through said casing in said wells, the lower ends of said tubing are slotted oppositely said casing perforations and said hydrocarbon bearing strata, an adjustable packer adjacent the slotted section of said tubing hermetically sealing said annulus between said tubing and said casing in said injection and production wells, the upper end of said tubing in said injection well in communication with a block valve, a tubing manifold in communication with said block valve, a deionized water supply pipe, a block valve between said deionized water supply pipe and said injection well tubing manifold, a catalyst slurry supply pipe and a block valve between said catalyst slurry pipe and said injection well tubing manifold all in communication with each other, whereby said deionized water is injected into said hydrocarbon bearing strata to displace salts which poison said hydrocarbon cracking catalyst and said hydrocarbon cracking catalyst slurry is injected into said hydrocarbon bearing strata in the process of this invention.

19. In an apparatus used to perform the process of catalytic stimulation of hydrocarbon recovery from porous and permeable hydrocarbon bearing strata in earth formations having at least one injection well and at least one production well each including a casing set and cemented through the same porous and permeable hydrocarbon bearing strata and perforated oppositely said hydrocarbon bearing strata, a well head at the upper surface end of said casings, tubing extending through said well heads hermetically sealing the annulus between said tubing and said casing in said injection and production wells, said tubing extending downwardly through said casing in said wells, the lower ends of said tubing are slotted oppositely said casing perforations and said hydrocarbon bearing strata, an adjustable packer adjacent the slotted section of said tubing hermetically sealing said annulus betwen said tubing and said casing in said injection and production wells, the upper end of said tubing in said injection well in communication with a block valve, a tubing manifold in communication with said block valve, a steam supply pipe, a block valve between said steam supply pipe and said injection well tubing manifold, a catalyst slurry supply pipe and a block valve between said catalyst slurry supply pipe and said injection well tubing manifold all in communication with each other, whereby said steam is injected into said hydrocarbon bearing strata to displace salts which poison said hydrocarbon cracking catalyst and to inject hydrocarbon cracking catalyst slurry into said hydrocarbon bearing strata in the process of this invention.

* * * * *